US010010837B2

(12) United States Patent
Meles

(10) Patent No.: US 10,010,837 B2
(45) Date of Patent: Jul. 3, 2018

(54) SHAKING DEVICE

(71) Applicant: Jean-Pierre Meles, Drancy (FR)

(72) Inventor: Jean-Pierre Meles, Drancy (FR)

(73) Assignee: CHOPIN TECHNOLOGIES, Villeneuve la Garenne (FR)

( * ) Notice: Subject to any disclaimer, the term of this patent is extended or adjusted under 35 U.S.C. 154(b) by 993 days.

(21) Appl. No.: 14/319,118

(22) Filed: Jun. 30, 2014

(65) Prior Publication Data

US 2015/0003183 A1 Jan. 1, 2015

(30) Foreign Application Priority Data

Jul. 1, 2013 (FR) ..... 13 56407

(51) Int. Cl.
*B01F 11/00* (2006.01)
*B01F 15/02* (2006.01)
(Continued)

(52) U.S. Cl.
CPC ..... *B01F 11/0005* (2013.01); *B01F 3/12* (2013.01); *B01F 9/0003* (2013.01);
(Continued)

(58) Field of Classification Search
CPC ... B04B 9/10; B04B 5/0421; B01F 15/00805; B01F 15/0237; B01F 3/12;
(Continued)

(56) References Cited

U.S. PATENT DOCUMENTS 1,417,219 A * 5/1922 Warren ..... B01F 11/0022 366/212
2,507,309 A * 5/1950 Larsson ..... B04B 5/0414 494/16
(Continued)

FOREIGN PATENT DOCUMENTS

EP 0 088 425 9/1983
FR 1 529 066 6/1968
(Continued)

OTHER PUBLICATIONS

French Search Report dated Mar. 13, 2014 in corresponding French Priority Application.

*Primary Examiner* — Charles Cooley
(74) *Attorney, Agent, or Firm* — Young & Thompson

(57) ABSTRACT

Device for shaking, within a rigid container, a powder and liquid, for conducting a test on the shaken content, includes: a frame; a first plate assembled thereto; a second plate assembled indirectly to the frame, arranged close to the first plate and movable relative to the frame and first plate; and a drive unit for moving the second plate relative to the frame and first plate. The container is carried by the second plate and is movably mounted relative thereto; the first plate includes a stop fixedly mounted on the first plate; and the second plate is moved relative to the first plate by the drive unit, in an alternating and periodic translational and/or rotational motion between a proximal position and a distal position, to move the container relative to the second plate
(Continued)

and cause a series of impacts between the container and the stop to achieve a non-periodic shaking.

20 Claims, 14 Drawing Sheets

(51) Int. Cl.

| | |
|---|---|
| ***B04B 5/04*** | (2006.01) |
| ***B04B 9/10*** | (2006.01) |
| ***B01F 9/00*** | (2006.01) |
| ***B01F 11/02*** | (2006.01) |
| ***B01F 15/00*** | (2006.01) |
| ***B01F 3/12*** | (2006.01) |

(52) U.S. Cl.
CPC ..... *B01F 11/0017* (2013.01); *B01F 11/0025* (2013.01); *B01F 11/0275* (2013.01); *B01F 15/00805* (2013.01); *B01F 15/0237* (2013.01); *B01F 15/0295* (2013.01); *B04B 5/0421* (2013.01); *B04B 9/10* (2013.01)

(58) Field of Classification Search
CPC ..... B01F 11/0025; B01F 15/0295; B01F 11/0275; B01F 9/0003; B01F 11/0017; B01F 11/0005
USPC ..... 494/16, 20, 31, 33, 47, 84; 366/213–214
See application file for complete search history.

(56) References Cited

U.S. PATENT DOCUMENTS 3,061,280 A * 10/1962 Kraft ..... B01F 11/0014 366/110
3,159,384 A * 12/1964 Davis ..... B01F 11/0014 211/74
3,401,876 A * 9/1968 Lucas ..... B04B 5/0421 494/10
3,420,437 A * 1/1969 Blum ..... B04B 5/04 494/20
3,439,871 A * 4/1969 Unger ..... B04B 5/0414 494/16
3,722,789 A * 3/1973 Kennedy ..... B04B 5/0421 494/1
3,877,634 A * 4/1975 Rohde ..... B04B 5/0421 494/1
3,951,334 A * 4/1976 Fleming ..... B04B 5/0421 494/20
4,285,463 A * 8/1981 Intengan ..... B04B 5/0421 494/20
4,329,068 A * 5/1982 Neuner ..... B01F 9/0021 366/214
4,449,964 A * 5/1984 Westberg ..... B04B 5/0421 494/16
4,820,257 A * 4/1989 Ishimaru ..... B04B 5/0414 494/16
4,990,130 A * 2/1991 Prais ..... B01F 11/0094 366/208
5,045,047 A * 9/1991 Hutchins ..... B04B 5/02 494/17
5,047,004 A * 9/1991 Wells ..... B04B 5/0421 494/17
5,178,602 A * 1/1993 Wells ..... B04B 5/0421 422/548
5,195,825 A * 3/1993 Ringrose ..... B01F 11/0005 366/110
5,199,937 A * 4/1993 Wada ..... B04B 9/10 494/11
5,354,254 A * 10/1994 Zabriskie ..... B04B 5/0414 494/12
5,558,616 A * 9/1996 Barkus ..... B04B 5/0414 494/12
5,567,050 A * 10/1996 Zlobinsky ..... B01F 11/0008 366/110
5,769,538 A * 6/1998 Sherman ..... B01F 11/0008 366/198
5,851,170 A * 12/1998 Howell ..... B04B 5/0421 494/20
6,059,446 A * 5/2000 Dschida ..... B01F 11/0008 366/208
6,234,948 B1 * 5/2001 Yavilevich ..... B01L 3/5021 494/20
6,235,245 B1 * 5/2001 Sherman ..... B01F 9/002 366/200
6,398,705 B1 * 6/2002 Grumberg ..... B04B 5/0414 494/16
6,837,843 B2 * 1/2005 Gazeau ..... B04B 5/0421 366/214
7,204,637 B2 * 4/2007 Sherman ..... B01F 9/0021 366/214
9,314,753 B2 * 4/2016 Sundar Raj ..... A61K 31/4245
9,695,392 B2 * 7/2017 Sherman ..... B01F 11/0005
2005/0277538 A1 * 12/2005 Sherman ..... B01F 9/0021 494/16
2008/0318755 A1 * 12/2008 Yamada ..... B04B 5/0421 494/9
2009/0312169 A1 * 12/2009 Yang ..... B04B 5/0421 494/9
2015/0003183 A1 * 1/2015 Meles ..... B01F 11/0005 366/110
2015/0005150 A1 * 1/2015 Meles ..... B04B 9/10 494/9
2017/0159000 A1 * 6/2017 Sherman ..... B01F 11/0005

FOREIGN PATENT DOCUMENTS

JP 58154662 A * 9/1983 ..... B04B 5/0421
JP 59019857 A * 2/1984 ..... B04B 5/0421

* cited by examiner

SHAKING DEVICE

FIELD OF THE INVENTION

The invention concerns the technical field of devices for shaking, within a rigid container, content comprising a material in powder form and a liquid product, for the purpose of conducting a test on content that has been processed at least by shaking, the container having a capacity of less than one liter and able to hold an amount of content suitable for the test.

More specifically, one object of the invention relates to the execution of a particular type of shaking by a mechanical device, for example in order to mix, shake, and/or blend the content of a container. For example, the "AACC—Method 56-11" standard established by the agency AACC International imposes specific conditions for shaking samples of flour and solvent mixtures in order to dissolve the flour for the purposes of determination and qualification. To obtain meaningful measurements, these conditions are achieved by manual shaking. Other standards, established practices, or good practices may also require or recommend specific methods of shaking which are currently performed manually due to lack of a mechanical device meeting the required or recommended criteria. However, with manual shaking the issue of accurate repeatability arises.

BACKGROUND OF THE INVENTION

Various proposed shaking solutions are known from the prior art.

U.S. Pat. No. 4,128,344 proposes a device for shaking a product contained in test tubes. The device comprises a drive unit with a planetary gear train that rotates the test tube, particularly about its main axis, in order to shake the contents.

Patent FR1529066 concerns a shaking device comprising tubes arranged on a turntable. The turntable is rotatable about a main axis. The rotation of the turntable shakes the tubes and their contents.

U.S. Pat. No. 3,980,227 relates to a shaking device having a central axis and a plate which rotates about an axis inclined relative to the central axis, in order to agitate containers. However, in addition to the complexity in implementing this device, the mixing is unsatisfactory.

Such embodiments allow a mechanical and reproducible shaking of tubes and their content. These solutions are unsuitable, however, for shaking content consisting of a material in powder form and a liquid product within a rigid container having a capacity of less than a liter, in a manner that is comparable to manual shaking. There is therefore a need for a device that can perform shaking comparable to manual shaking, which is simple to implement and can be used in particular for conducting quality tests, for example such as quality tests on flour samples according to the 56-11 method defined by AACC International.

For this purpose, the device for shaking, within a rigid container, content comprising a material in powder form and a liquid product, for the purpose of conducting a test on the shaken content, said container having a capacity of less than one liter and able to hold an amount of content suitable for conducting the test according to the invention, comprises:

- a frame,
- a first plate, assembled directly or indirectly to the frame,
- a second plate assembled indirectly to the frame, arranged close to the first plate and movable relative to the frame and to the first plate, and

- a drive unit suitable for moving the second plate relative to the frame and to the first plate, and is characterized in that:

- the container is carried by the second plate and is movably mounted relative to the second plate,
- the first plate comprises a stop, said stop being arranged near to and facing the container, the stop being fixedly mounted on the first plate, and
- the second plate is moved relative to the first plate by means of the drive unit, in an alternating and repeating translational and/or rotational motion between a proximal position and a distal position, so as to move the container relative to the second plate and cause a series of impacts between the container and the stop in order to achieve a non-periodic shaking of the container by the alternating and repeating motion of the second plate.

With this embodiment, the shaking that results is non-periodic or irregular and reproduces a manual shaking. Among other things, such irregular mixing allows blending to complete homogenization. In addition, the device can be implemented simply and can be associated with other devices: for example it can be associated with a centrifuge in order to conduct tests and assays.

In one embodiment, the second plate has a plate axis, and the container is assembled to the second plate and is rotatable about the plate axis. The relative rotational motion of the container in relation to the second plate limits the damage that could result from the series of impacts between the container and the stop and increases the irregularity of the shaking.

According to an additional embodiment, the container is a test tube and comprises a rigid hollow body extending longitudinally along a container axis between a first end and a second end, the second end defining an opening for the filling thereof. The container has an elongate shape which allows specific kinematics, thereby increasing the irregularity of the shaking.

According to an additional embodiment, the plate axis is located substantially nearer to the first end or to the second end; the plate axis is not equidistant from the first end and the second end. The path traveled by the container end furthest from the plate axis is longer than the path traveled by the container end closest to the plate axis.

In one embodiment, the stop is a rigid stop and the impact between the container and the stop is an elastic or substantially elastic collision. This elastic or quasi-elastic collision causes the container to rebound from the stop. There is substantially no permanent deformation of the container or of the stop. More specifically, the rigid container can rebound from the stop, creating movement of the rigid container that is not directly controlled by the drive unit.

In one embodiment, the drive unit moves the second plate in translation with respect to the first plate, between the proximal position and the distal position, along a shaking axis in a first direction and in a second direction that is opposite the first direction. The movement of the second plate alternates between translational motion in a first direction and translational motion in a second direction. The translational motion of the second plate relative to the first plate in one direction then the other is easy to implement, for example by means of a drive unit such as a motor.

In one embodiment, the shaking axis is orthogonal to the plate axis. The sliding motion along the shaking axis (also known as the driving motion) causes rotational movement of the container about the plate axis (also known as the driven motion), and the orthogonality of the shaking axis with the plate axis allows optimizing the amplitude of the driven motion.

In one embodiment, the course of the second plate between the proximal position and the distal position is between 10 millimeters and 50 millimeters in length, preferably about 35 millimeters. For a container having a capacity of less than a liter, a course of between 10 millimeters and 50 millimeters in length and preferably about 35 mm is optimal for satisfactory blending. The reduced size of this stroke allows the shaking device to be compact.

In one embodiment, the drive unit moves the second plate in a periodic motion at a frequency of between 1 and 10 Hertz, preferably at a frequency of about 5 Hertz. The periodic translational motion of the second plate is repeated several times per second. For example, the second plate moves at a frequency of about five oscillations per second. The range of oscillation frequencies is provided by control elements which are readily available commercially and which correspond to the recommended frequency for the manual shaking method used for flour determinations according to method 56-11 of the AACC International.

In one embodiment, the second plate has a second stop limiting the angular travel of the container about the plate axis. The second stop allows the device to be more compact by reducing the possible angular travel of the container about the plate axis. In addition, a second impact can be brought about between the second stop and the container. The second impact can amplify the irregularity of the container movement.

According to one embodiment, the pivoting of the container about the plate axis has an angular travel of less than 120°, preferably about 60°. With such angular travel, shaking similar to manual shaking can be achieved. This angular travel is measured, for example, between a first position of the container when it is in contact with the stop of the first plate, and a second position of the container when it is in contact with the second stop.

In one embodiment, the container is detachably associated with the second plate, the second plate comprises a notch, and the shaking device further comprises a connecting member which connects the container to the second plate, said connecting member cooperating with the notch and being assembled to the second plate and rotatable relative to the second plate about the plate axis, said connecting member comprising:

- a first portion for detachably receiving the container,
- a second portion extending along the plate axis, allowing rotation of the container about the plate axis relative to the second plate.

In one embodiment, the shaking device comprises a plurality of containers, the first plate defines a central axis and the second plate defines a second central axis with the first and second axes being coaxial, the first plate comprises the same number of stops as the number of containers, and each container is associated with a stop. It is thus possible to shake multiple containers simultaneously, which reduces testing and assay time. In addition, the shaking is similar for all the containers.

A second aspect of the invention relates to the use of the shaking device as described above, for the purpose of measuring the absorption capacity of a flour sample for a solvent.

A third aspect of the invention relates to a method for shaking a container, comprising the steps of:

- having a shaking device as described above,
- partially filling the container with a material in powder form and with a liquid product,
- setting the second plate in motion by means of the drive unit in an alternating and repeating translational and/or rotational motion so as to move the container relative to the second plate and cause a series of impacts between the rigid container and the stop in order to achieve a non-periodic shaking of the container by the alternating motion of the second plate,
- stopping the motion of the second plate.

According to one embodiment of the method, the steps of setting the second plate in motion and stopping the motion of the second plate are repeated.

According to one embodiment, the method further comprises a step of placing the container on the second plate and a step of removing the container from the second plate.

BRIEF DESCRIPTION OF THE DRAWINGS

The figures from the drawings are now briefly described.

DETAILED DESCRIPTION

A detailed description of several embodiments of the invention combined with examples and references to the drawings is given below.

Figure 1:
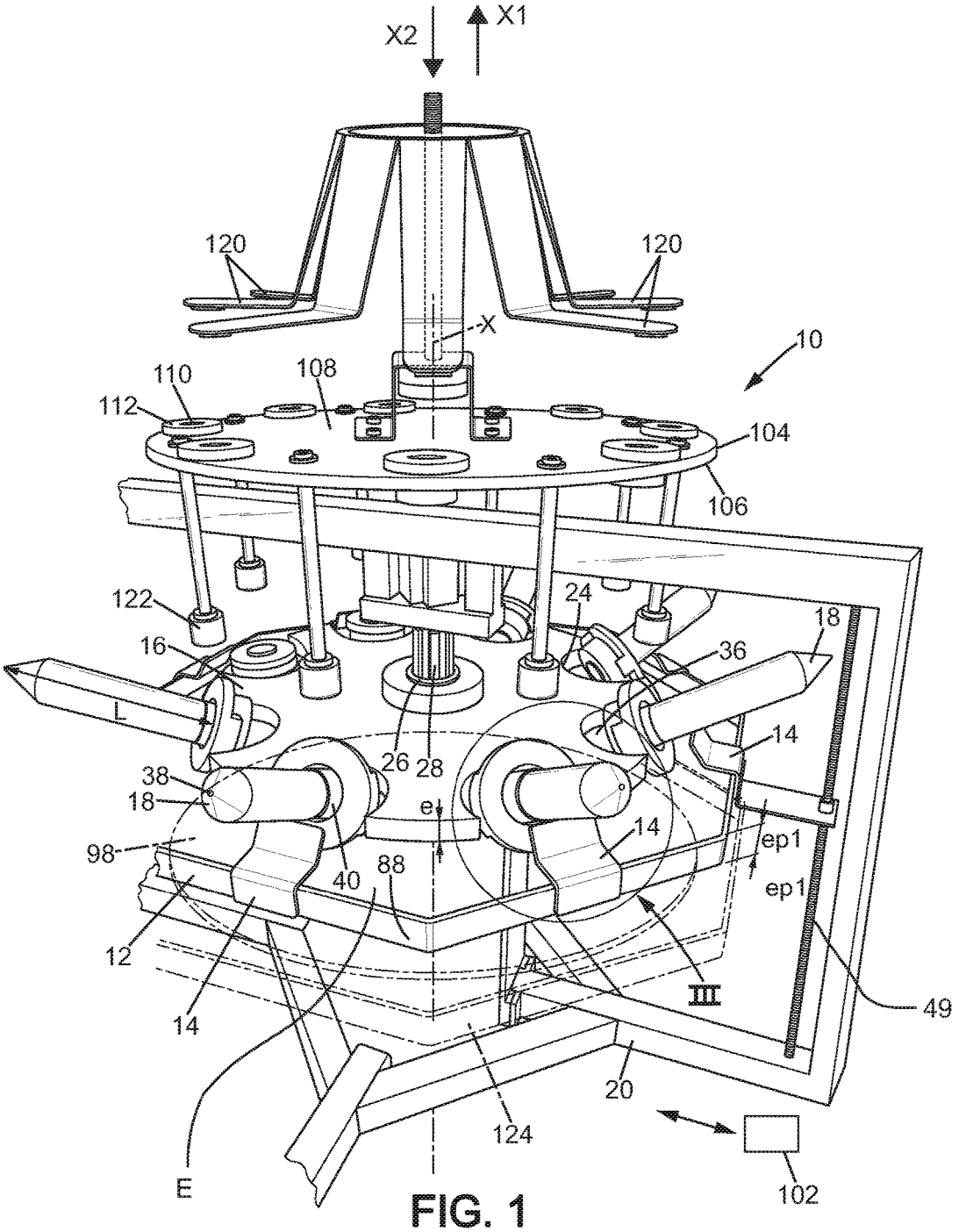
FIG. 1 is a perspective view of the shaking device according to the invention which is also a shaking and centrifuging device according to the invention comprising a first and second plate, containers and units for connecting containers to the second plate.

FIG. 1 illustrates a shaking device 10 according to the invention. The shaking device 10 includes a first plate 12. The first plate 12 comprises a stop 14. The shaking device further comprises a second plate 16. The second plate 16 supports a container 18. The first plate 12 and the second plate 16 form a substantially flat structure. However in implementation variants, the first and/or second plate 12, 16 can be like a wheel, or be another structure than flat or circular.

The first plate 12 and the second plate 16 are mounted each assembled to a frame 20. Typically, the frame 20 of the shaking device 10 rests on a support S (which can be the ground or a tabletop for example). The support S defines a plane. Subsequently, the description is made with reference to the case where the first plate 12 and the second plate 16 are arranged substantially horizontally, orthogonal to a vertical axis. But it must be understood that the device 10, when it is not in use, can be arranged in any orientation.

In the following description, it is appropriate to understand by "vertical" direction any direction parallel—or substantially parallel—to the direction normal to the plane of the support S. Additionally, "horizontal" direction needs to be understood as any direction parallel—or substantially parallel—to the plane of the support S and orthogonal—or substantially orthogonal—to the vertical direction.

As illustrated in FIG. 1, the first plate 12 is a metal framework type structure assembled to the frame 20 and the second plate 16 has the shape of a carousel.

More precisely, the second plate 16, as shown on FIG. 1, has a substantially circular contour of diameter D. However, as previously indicated, in the implementation variants the second plate 16 can have other shapes. For example the second plate 16 can have a square contour, a variable thickness or even be asymmetric.

The second plate 16 is substantially horizontal. The second plate 16 is centered around an axis subsequently called the shaking axis X. The shaking axis X forms the central axis of the second plate 16. In this case, the shaking axis X extends vertically. The second plate 16 has a lower surface 22 oriented towards the support S and an upper surface 24 opposite said lower surface 22. The second plate 16 comprises an outlet orifice 26 in its center main axis of which is the shaking axis X. A shaft 28 along the direction of shaking X and combined with the frame 20 extends in the opening orifice 26. The shaft 28 can be fixed relative to the frame 20 or else rotationally movable relative to the frame 20 around the shaking axis X. As shown, shaft 28 is spindled and the grooves of the shaft 28 engage with a complementary shape on the second plate 16 in order to avoid, among other things, any involuntary rotation of the second plate 16 around the shaft 28 or else to transmit rotation from the shaft 28 around the shaking axis X to the second plate 16. However, in implementation variants, the shaft can be provided with a housing suited for receiving a key, or can be designed smooth. The second plate 16 is slidably mounted on the shaft 28 along the shaking axis X.

Figure 8:
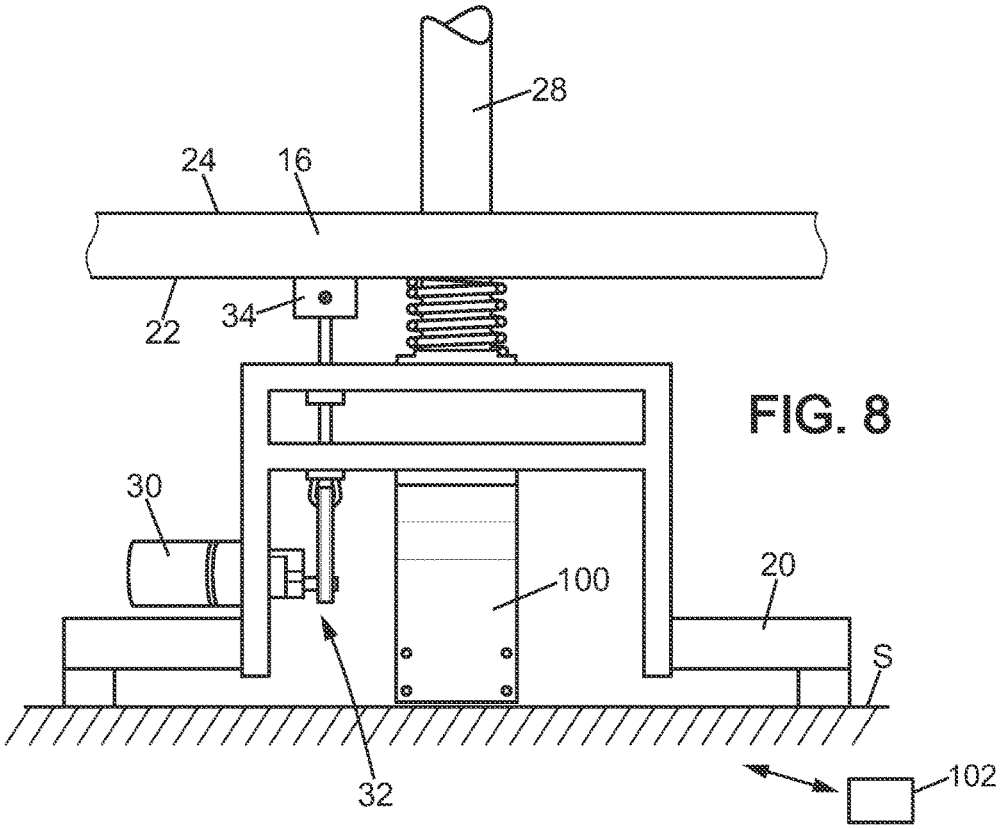
FIG. 8 is a detailed perspective view of a drive system comprising a first and second drive unit for the second plate of the shaking and centrifuging device from FIG. 1 where the first and second drive units respectively drive the second plate in a shaking mode and in a centrifuging mode.

A drive system, comprising a drive unit 30 and for example a crank-control rod system 32 (illustrated in FIG. 8), drives the second plate 16 translationally along the shaking axis X. The drive unit 30 can be rigidly attached to the frame 20. The drive unit 30 is attached to the second plate, for example, by a magnetic attachment system. A fork 34 with several branches (for example three) is in this case attached directly to the crank of the control rod-crank system 32 to provide contact at several points (each of the branches of the forks 34 is in contact with the lower surface 22 of the second plate 16). The fork 34 further comprises magnetic strike plates on all our part of the branches thereof for preventing the second plate 16 from being disassembled from the fork 34 (and consequently for preventing the disconnection of the second plate 16 and the drive unit 30). The magnetic strike plates avoid any loss of contact between the second plate 16 and the fork 34 and therefore the second plate 16 can be driven precisely translationally along the shaking axis X. In an implementation variant, the fork 32 can be a circular or rectangular part. The second plate 16 is movable translationally between a proximal position (also called lower position), in which the lower surface 22 of the second plate 16 is at a first distance d1 from the support S, where the distance d1 is measured along the shaking axis X, and a distal position (also called upper position), in which the lower surface 22 of the second plate 16 is at a second distance d2 (not shown) from the support S. The distance d2 is greater than the distance d1.

The drive unit 30, by means of the crank control rod system 32, drives the second plate 16 translationally along the shaking axis X in a first shaking direction X1, when the second plate 16 is moved from the proximal position to the distal position, and in a second shaking direction X2, opposite the first direction X1. The translation movement of the second plate 16 is alternating and can be repeated periodically. In this instance, the proximal and distal positions are fixed positions. Second plate 16 moves between two and positions and once one of the end positions is reached, the second plate 16 moves in the opposite direction. In this implementation, the end positions are constant. However, in a variant implementation, it is possible to provide variable distal and proximal positions. In this implementation variant, with each back-and-forth movement, the second plate 16 would not necessarily return to the preceding proximal (respectively distal) position thereof but would adopt a new proximal (respectively distal) position in the area of the preceding proximal (respectively distal) direction. Additionally, in implementation variants, a different system from the crank control rod system 32 can be provided for the alternating movement of the second plate 16. For example the drive unit could be a piezoelectric motor for which the motor shaft would be assembled directly to the second plate 16 for driving it translationally in the first direction X1 and then in the second direction X2.

The second plate 16 comprises a recess 36. As shown in FIG. 1, the second plate 16 comprises a plurality of recesses 36, in this case the second plate 16 comprises eight recesses 36. With each recess 36 is associated a container 18 adapted for containing a content including a material in the pulverulent state and a liquid product. The number of recesses 36 depends on the number of containers 18 intended to be shaken and can be larger or smaller. For example, the number of recesses can vary between one and 16. The recesses 36 are equally distributed around the shaking axis X at the periphery of the second plate 16. The recesses 36 each form circular portions of diameter d less than diameter D of the second plate and the center thereof on or near the periphery of the second plate 16. The recesses 36 pass through the thickness e of the second plate 16 and open-out in the radial direction of the second plate 16 and towards the outside of the second plate 16. As shown, the recesses 36 have substantially similar shapes, however in some implementation variants each recess 36 can have a different shape and/or size.

The size of the recesses 36 depends on the container 18. In this case, the recesses 36 form a passage for the container 18 which is assembled to the second plate 16 and the passage formed by the recess 36 is sufficiently large to allow a rotation of the container 18 relative to the second plate 16 around a plate axis A which will be described later.

Specifically, the size of the shaking device 10 depends on the intended number of containers 18 and on the size of the containers 18. The numeric dimensions given in the remainder of the description are possible dimensions for a shaking device 10 comprising eight containers 18 and are in no way limiting.

The container 18 is cylindrical and is a test tube or sample container type. The container 18 comprises a rigid hollow body 37 with circular section of substantially constant diameter dr (not shown) and extends longitudinally along a container axis Xr between a first end 38 and a second end 40. The container 18 is long and defines an inside volume. The container 18 has a capacity or, in other words an interior volume, less than or equal to one liter and, more specifically, a capacity adapted, and in particular just adapted, to a specific content quantity for doing the test. Specifically, the container 18 has a capacity of order 50 mL. Furthermore, the length of the container L measured along the container axis Xr is of order 120 mm and the container diameter dr is of order 30 mm.

The container 18 defines at the second end 40 thereof a filling opening 42 for partially filling the container 18 with a content comprising a material in the pulverulent state and a liquid product.

The container 18 is suited for containing a content including a material in the pulverulent state and a specific liquid product and intended to be tested or measured. The shaking device 10 homogenizes the material in the pulverulent state and the liquid product for the purpose of conducting tests or measurements, for example measurement of the capacity of the pulverulent material to absorb the liquid product. However, in implementation variants other types of measurements can be performed. Additionally, the content of the container 18 can vary with the product sample being studied. Also, for example, the container 18 can contain a plurality of liquid products.

The first end 38 of the container is closed, for example by a conic portion. However, in a variant, the first end 38 is a hemispheric portion.

The container 18 is rotationally movable relative to the second plate 16 around a plate axis A. The plate axis A is fixed relative to the second plate 16. The plate axis A is additionally orthogonal to the shaking axis X. In this case the plate axis A is substantially horizontal. The plate axis A is tangent to a circle centered on the shaking axis X. The plate axis A is located near one of the ends 38, 40 of container 18. The plate axis A passes by an end part of container 18. As shown in FIG. 1, the plate axis A passes by the end part of container 18 in the area of the second end 40, and is distant from the first end 38. The plate axis A can be parallel to a diameter of the container 18 On the second end thereof, the container 18 comprises a support part Sp. The support part Sp forms a "neck" of container 18. The support part Sp extends radially towards the outside of container 18 and has a diameter greater than the diameter dr of the hollow body 37 of the container 18.

Figure 2:
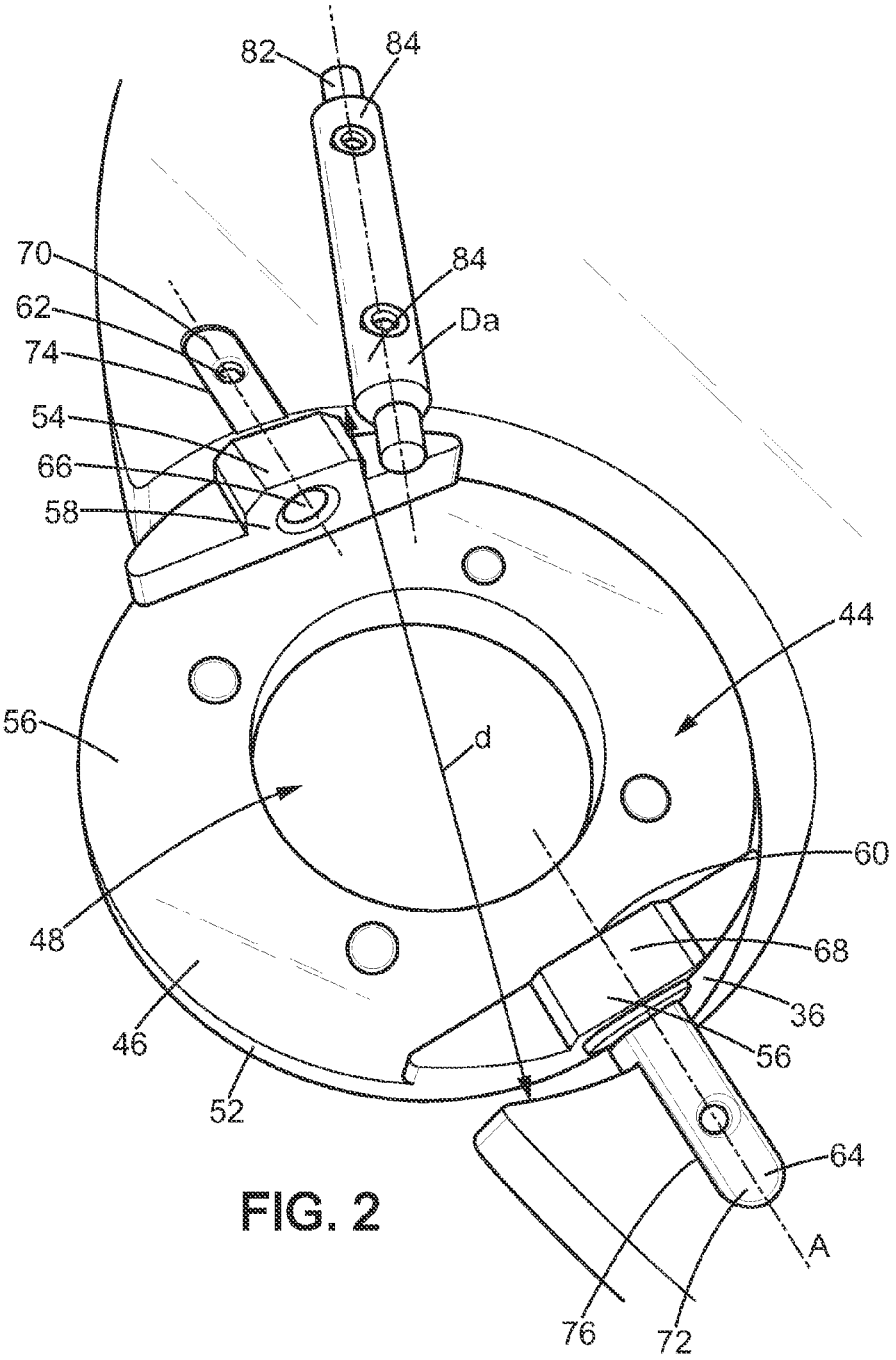
FIG. 2 is an enlarged scale top view of the connection unit from FIG. 1.

The container 18 is assembled to the second plate 16 by a connection unit 44 (also called nacelle), shown in FIGS. 1 and 2. The container 18 is removably assembled to the second plate 16. The connection unit 44 forms an intermediate element serving in particular to support the container 18 and to make the assembly of container 18 to the second plate 16 easier. The connection unit 44 also makes it easier to disconnect the container 18 and the second plate 16. However, in an implementation variant, the container 18 can be provided directly assembled to the second plate 16 without intermediate element. Or else, the connection unit 44 can have the full or partial shape of a glove finger and thus directly receive the container 18.

The connection unit 44 is in this case assembled non-removably to the second plate 16. The connection unit 44 is rotationally movable around the plate axis A. As shown in FIG. 2, the connection unit 44 comprises a collar 46. The collar 46 supports the container 18. The collar 46 is annular. However, the collar 46 can have a substantially different shape in an implementation variant. The collar 46 defines an opening 48. The collar 46 comprises an upper surface 50 oriented like the upper surface 24 of the second plate 16 and a lower surface 52 oriented like the lower surface 22 of the plate 16. The connection unit 44 comprises an upper surface 50 of the collar 46, a first projection 54 and a second projection 56 defining a first bearing 58 and a second bearing 60 on opposite sides of the opening 48. The connection unit 44 further comprises a first pivot-pin 62 and a second pivot-pin 64. The first pivot-pin 62 and the second pivot-pin 64 each comprise a first end 66, 68 and a second end 70, 72. The first end 66 of the first pivot-pin 62 is held in the first bearing 58 and the first end 68 of the second pivot-pin 64 is held in the second bearing 60. The first end 70 of the first pivot-pin 62 and the second end 72 of the second pivot-pin 64 are attached onto the second plate 16. The second end 70 of the first pivot-pin 62 and the second end 74 of the second pivot-pin 64 are respectively attached in a first and a second housing 74, 76 provided in the upper surface 24 of the second plate 16. The first pivot-pin 62 and the second pivot-pin 64 are coaxial and serve to rotationally guide the connection unit 44 relative to the second plate 16 around the plate axis A. Subsequently, the first pivot-pin 62 and the second pivot-pin 64 extend along the plate axis A. The first and second pivot-pins 62, 64 can, for example, be made of metal whereas the first and second projections 54, 56 can be made of plastic. In an implementation variant, a single pivot-pain can be provided. Of course, a variant could swap the pivot-pins and bearings (or rings) in the sense that the pivot-pins (or axes) could be rigidly connected to projections 54 and 56, with the bearings than being rigidly connected to the plate 16 by additional supports or flanges.

As shown in FIG. 2, when the upper surface 50 of the collar 46 of the connection unit 44 is substantially parallel to the upper surface 24 of the second plate 16, the upper surface 50 of the collar does not lie in the extension of the upper surface 24 of the second plate 16 but is recessed relative to the upper surface of the second plate in the direction of support S.

The collar 46 is adapted and intended to receive and hold the container 18 The container 18 is received in and held by the collar. The dimensions of the collar 46 are dependent on the dimensions of the container 18. An operator, for example, assembles the container 18 to the collar 46 by first inserting the first end 38 of the container 18 into the opening 48 of the collar 46. The operator next translates the hollow body 37 of container 18 in the opening 48 of the collar 46. The opening 48 of the collar 46 has a dimension slightly greater than the dimension of the hollow body 37 to allow translation and thus a force-free placement of the container 18. The container 18 comes to stop against the collar near the second end 40 thereof. The support part Sp of the container 18 whose diameter is furthermore greater than the diameter of the opening 48 of the collar 46 comes to stop against the upper surface 50 of the collar 46. The container 18 is thus held in and supported by the collar 46. Container 18 can easily be positioned on the connection unit 44 and also easily withdrawn from the connection unit 44.

Optionally, the collar 46 and the support part Sp of the container 18 could comprise magnetic elements which create a first retention force between the container 18 and the annular collar 46. The first retention force secures the hold of the container 18 in the collar. With an alternating north and south pole of the magnetic elements, container 18 could, among other things, always be positioned similarly in the collar 46 whatever the angle of insertion thereof in the collar 46.

The container 18 comprises a stopper 80 suited for closing the filling opening 42. The stopper 80 can, for example be held in closed position on the container 18 by means of magnetic elements creating an attractive force between the stopper and the support part of the container 18, for example. For example magnets can be provided distributed angularly on the container support part 18 and/or on the stopper. In an implementation variant, the cap is screwed on the container 18. Just the same, a faster stoppering is possible with magnetic elements.

Additionally, the retention force of the stopper 80 on the container 18 is preferably less than the retention force of the container 18 on the second plate 16. Thus the stopper 80 can be pulled out of the container placed on the second plate 16 to unplug the container 18 without displacing the container 18 out of the collar 46.

In an implementation variant, the container 18 could possibly not have a stopper and the filling opening would be left open. In this case, to avoid any splashing of the content of container 18 outside of said container 18 during shaking, the quantity present in the container 18 should be distinctly less than the capacity of the container 18, for example. Additionally, the shaking device should not allow the filling opening to be oriented toward the support S.

In the absence of external stresses, in particular in the absence of any external stress on the second plate 16, on the container 18 and on the connection unit 44, the upper surface 50 of the connection unit collar may be substantially parallel to the upper surface 24 of the second plate 16, and the axis of container 18 can be substantially vertical. The positioning of the container 18 and the connection unit 44 and/or the withdrawal of the container 18 from the connecting unit 44 is thus easier.

When the second plate 16 is driven in a back-and-forth translational movement along shaking axis X (also called driving movement), it can lead to a rotational movement of the container 18 around the plate axis A (also called driven movement).

As an example, FIG. 1 shows containers 18 in various positions. The configuration of containers from FIG. 1 is not a usual operating configuration of shaking device 10, but it shows the independence of each of the containers from each other. More specifically, FIG. 1 shows eight containers 18 in two different positions. Two of the eight containers 18 shown are substantially vertical, whereas the other six containers are each resting against a stop 14. As shown in FIG. 1, the position of one container 18 is independent of the position of the other containers 18.

Although the device can be provided with up to 16 places for containers, nothing prevents equipping the device with fewer tubes than places.

The second plate 16 further comprises a second stop 82 attached to the upper surface 24 thereof. The second stop 82 constitutes a means for limiting the rotation of the connection unit 44 around the plate axis A, and consequently limiting the pivoting of the container 18 around the plate axis A. The second stop 82 prevents a complete rotation through 360° of the connecting unit 44 around the plate axis A. In this case, and as shown in FIGS. 1 and 2, the second stop 82 extends opposite the recess 36. The second stop 82 comprises a bar 84, for example of plastic, which extends along a direction Da which is parallel to the direction of plate axis A, or inclined thereto at an angle less than 90°. The stop direction DA is not coincident with the direction of plate axis A. The second stop 82 extends opposite the upper surface 50 of the collar 46. The second stop 82 does not block or interfere with the opening 48 of the collar 46. In other words, the second stop 82 does not impede the insertion or removal of container 18 from opening 48. The second stop 82 is, as shown, assembled on the second plate 16 with screws. The second stop 82 is arranged between plate axis A and orifice 26 of the second plate 16. Of course, these stops can be of different shapes and materials and have another attachment method.

As shown in FIGS. 1 and 2, when the second plate 16 comprises several recesses 36, the second stop 82 of the first recess 36 and of a second recess 36 adjacent to the first recess is made of a single part comprising one first bar 84 and one second bar as a single unit. The first bar 84 forms the second stop for the first recess and the second bar forms the second stop for the second recess. In a variant, it is possible to provide a stop dedicated to each recess. Similarly, in an implementation variant limiting the travel of the connection unit can be done by other means. For example, the function of limiting the pivoting of the container around the plate axis A could be done by a rotational blockage provided in the first and second bearings 58, 60 for the first and second pivot-pins 62, 64.

The travel of the container 18 is also limited by the stop 14 of the first plate 12.

The first plate 12 is a structure of metal (or any other material) defining in the interior space E. The first plate 12 is assembled to the frame 20 as previously described. The first plate 12 is moved translationally relative to the frame 20 along an axis parallel to the shaking axis X via a motor system, for example of the type comprising a motor and a wheel and endless-screw system. In this case, the first plate 12 is assembled to the frame 20 by means of two wheel and endless-screw systems 49 (only one of which is shown in FIG. 1) which are each arranged on opposite sides of the first plate and diametrically opposite each other. The endless-screw extends longitudinally between two armatures of the frame 20. However, in an implementation variant the first plate 12 can be assembled fixed to the frame 20, for example by welding. In other implementation variants, the first plate 12 can be movable relative to the frame 20 along an axis not coaxial with the shaking axis X.

The first plate 12 arranged movable relative to the frame 20 is suited for being moved between a first position, subsequently called operating position, and a second position subsequently called rest position and possibly a third position referred to as emptying. In operating position, the stop 14 of the first plate 12 is arranged in such a way that container 18 (and more specifically a part of container 18, for example a part of the hollow body 37 of the container 18) can be resting on and/or in contact with said stop 14 while forming a nonzero angle with the vertical. In resting position, the stop 14 of the first plate 12 is offset radially and axially (in reference to the shaking axis X) from the container 18, in a way that the container 18 cannot rest on the stop 14 or even come into contact with said stop 14.

In the implementation variant in which the first plate 12 is assembled fixed relative to the frame 20, the first plate 12 is attached directly in the position referred to as "operating", specifically the stop for the first plate 12 is arranged such that the container 18 can be resting on and/or in contact with said stop 14.

The first plate 12 comprises a main axis which is coaxial with the shaking axis X. The first plate 12 is, for example, made from a metal band which is folded and closed on itself with the ends thereof butt welded to each other so as to form the interior space E. However, in implementation variants, the first plate 12 can have a different shape.

In resting position, the plate 12 is located between the support S and the second plate 16 in the axial direction. In the position referred to as operating, the first plate 12 can for example be located above the second plate 16. However, these relative positions of the first and second plates 12, 16 in operating position are dependent in particular on the length L of the container 18 and, for example, in operating position, the first plate 12 can be planned slightly beneath the second plate 16.

The first plate 12 comprises an inner surface 86 oriented towards the inner space E and an outer surface 88 opposed to the inner surface 86.

As previously mentioned, the shape and dimensions of the first plate 12 depend on the number of containers 18 intended for the shaking device 10 and the size of these containers 18. In this case, for a shaking device 10 comprising eight containers 18, the first plate has a substantially octagonal shape and a stop 14 and a container 18 are associated with each edge of the octagon, and the diameter of the circle inscribed in the octagon formed by the first plate is concentric with the circle of diameter D delimited by the second plate.

The stop 14 of the first plate 12 is substantially opposite the container 18 and forms a resting surface and a collision surface for the container 18. Additionally, the stop 14 also performs a function of limiting the travel of container 18 around the plate axis A.

Figure 3:
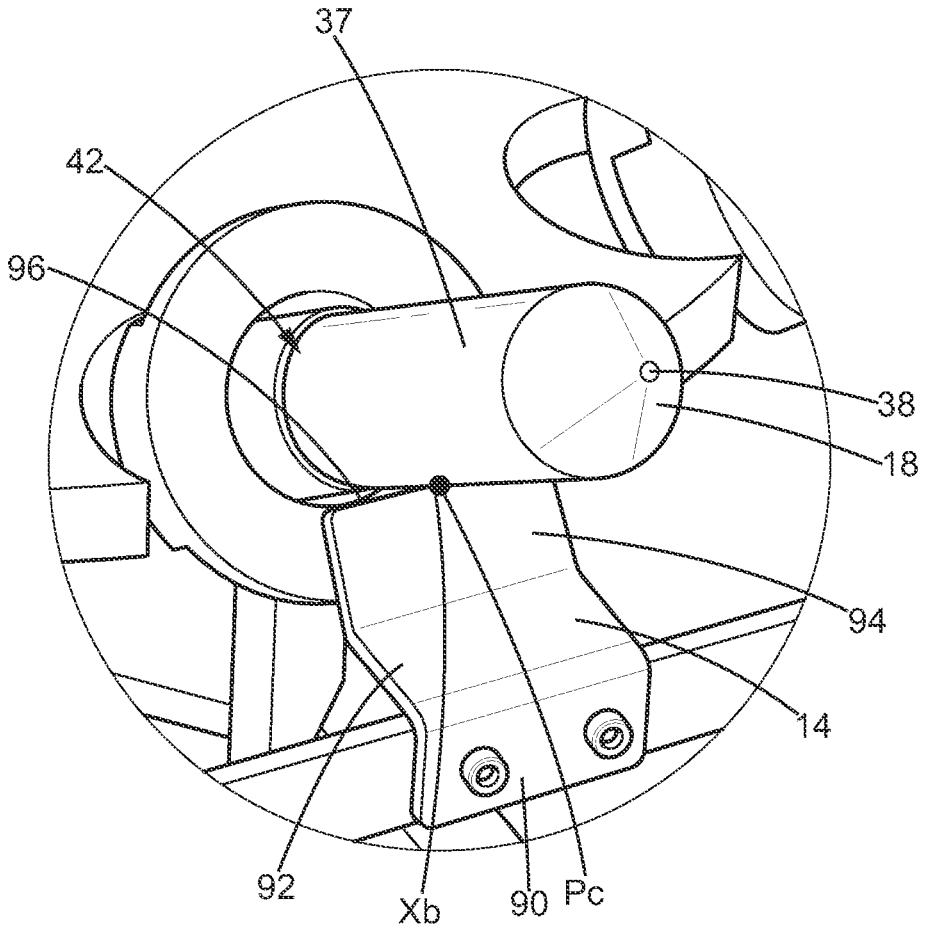
FIG. 3 is an enlarged scale view of the zone referenced III in FIG. 1, which illustrates a container resting against a stop on the first plate.

In this case, and as shown in FIG. 3, the stop 14 is a folded sheet metal piece comprising a first portion 90, a second portion 92 and a third portion 94, all flat.

The first portion 90 is an attachment portion for the stop 14 on the first plate 12. The first portion 90 of the stop 14 is attached on the outer surface 88 of the first plate 12. The second portion 92 of the stop extends substantially towards the inner space E defined by the first plate.

The second portion 94 of the stop 14 extends substantially along an angle of order 45° relative to the second portion 92 and towards the second plateau 16. The third portion 94 of the stop 82 comprises an edge which forms the stop surface 96 for the container 18, when the container 18 is in mounted (or assembled) position on the second plate 16. The resting of container 18 on the stop surface 96 is shown in more detail in FIG. 3.

Furthermore, in position for operation of the first plate, the relative position of the first plate 12 relative to the second plate 16, and consequently the position of the stop surface 96 relative to hollow body 37 of the container 18, is such that—in the absence of any relative movement of the second plate 16 relative to the first plate 12—the axis of container 18 is inclined relative to the vertical direction. As shown in FIG. 1, when the first plate 12 is an operating position and the second plate 16 is in proximal position, the container axis Xr forms an angle between 15° and 70°, or even of order 43° with the horizontal. The first end 38 of the container 18 is above the second end 40 of the container 18. The filling opening 42 is turned towards the support S.

The contact point Pc between the stop surface 96 and the hollow body 37 of the container 18 when the first plate 12 is in operating position is, for example, located 40 mm from the second end 40 of the container 18.

The shaking device 10 could possibly include a third plate 98 (shown transparently by dashes on FIG. 1) whose purpose is to tip the container 18. The third plate 98 serves to incline the container 18 relative to the vertical direction such that the first plate—and more specifically the stop surface 96 of the first plate 12—can come into contact and rest against container 18. The third plate 98 is assembled fixed relative to the frame 20 of the device. It can however be rotationally movable in particular around an axis substantially coaxial with the shaking axis X, in particular to make cleaning of the device easier.

More precisely and as previously mentioned, in resting position of the first plate 12, the stop 14 is at a distance from the container 18. In other words, the container 18 is not resting on the stop 14 and, since it is not subject to any external force, the container axis Xr is vertical By displacing the second plate from the distal position thereof to the proximal position thereof, the second plate 16 puts the container 18 in contact with the third plate 98 which leads to the inclination of the container 18, for example by an angle of order 45° relative to the vertical direction, where the first end of the container 18 is oriented towards the support S and such that the first plate 12, during translation thereof from the resting position thereof towards the operating position thereof, can come into contact with the container 18 and move the container 18 into the operating position of the first plate 12.

Putting the shaking device 10 into use comprises for example the following steps.

In a first step, the first plate 12 is in the resting position thereof, the second plate 16 is in the distal position thereof and the container axis Xr is substantially vertical and each of the containers 18 can be partially filled with a product to be shaken, for example a mixture of the material in the pulverulent state with a liquid product, or even several liquid products.

In a second step, if the shaking device 10 comprises a third plate 98, the second plate 16 is displaced so that the containers come into contact with the plate 98 who shape makes the container axis Xr incline, then the first plate 12 is moved translationally along the shaking axis X in the direction X1 until in the operating position of the first plate 12.

Figure 4A:
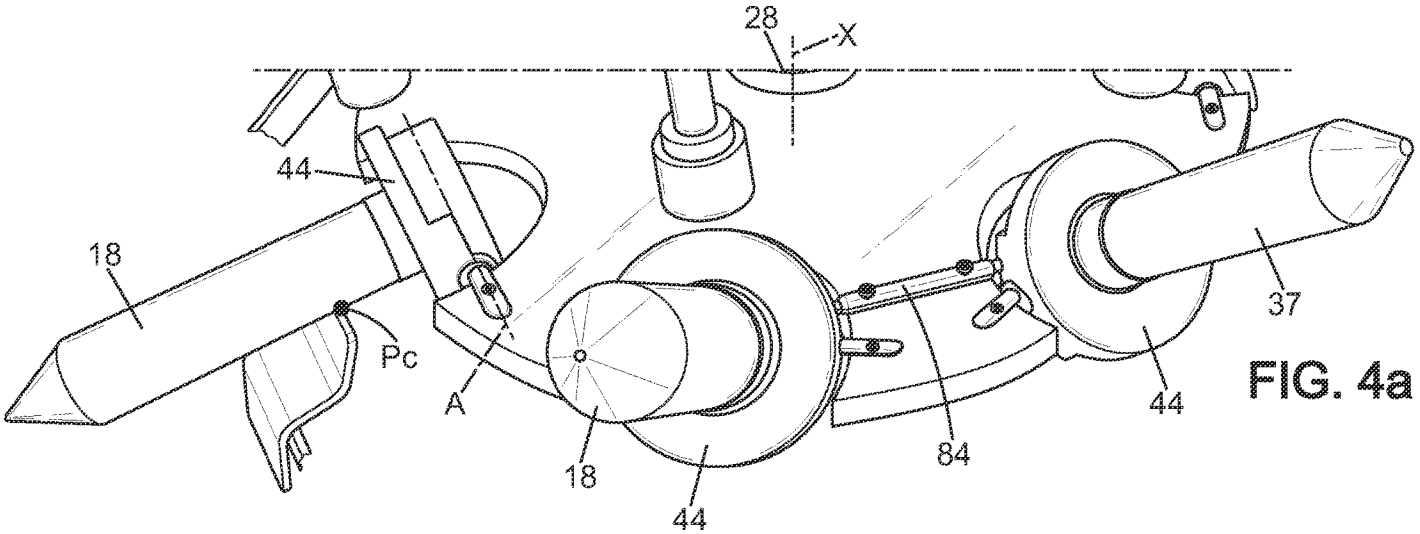
FIGS. 4*a* and 4*b* are perspective views showing the second plate from FIG. 1 in a distal and proximal position respectively.

In a third step, the drive unit 30 is actuated and moves the second plate 16 translationally along the shaking axis X in the first direction X1 into the distal position. The FIG. 4*a* shows the second plate 16 in distal position. For example, the second plate 16 travels a distance included between 10 mm and 50 mm, preferably of order 35 mm on the shaft in a first direction X1 until reaching the distal position. In distal position, the angle between the container axis Xr and the shaking axis X is nearly orthogonal. Once second plate 16 has reached the distal position, the drive unit 30 moves the second plate 16 in the second direction X2 towards the proximal direction before displacing the second plate 16 again into distal position. The second plate 16 thus makes a periodic and alternating displacement, or in other words a back-and-forth in the first direction X1 and the second direction X2.

The translational displacement of the second plate 16 leads to the displacement of the part of the container 18 which is directly assembled thereto via the connection unit 44. When the oscillations in the first direction X1 and second direction X2 of the second plate 16 are weak, for example less than 1 Hz, the container 18 pivots periodically in one direction and then in the opposite direction around the support point thereof on the stop surface 96 and more specifically around an axis (also called hereafter stop axis Xp) defined by the contact zone between the hollow body 37 of the container 18 and the stop surface. The contact between the container 18 and the stop 14 is always present when the displacement of the second plate 16 is sufficiently slow. The pivoting around the stop axis Xb then has the same frequency as the translational movement of the second plate 16.

Figure 4B:
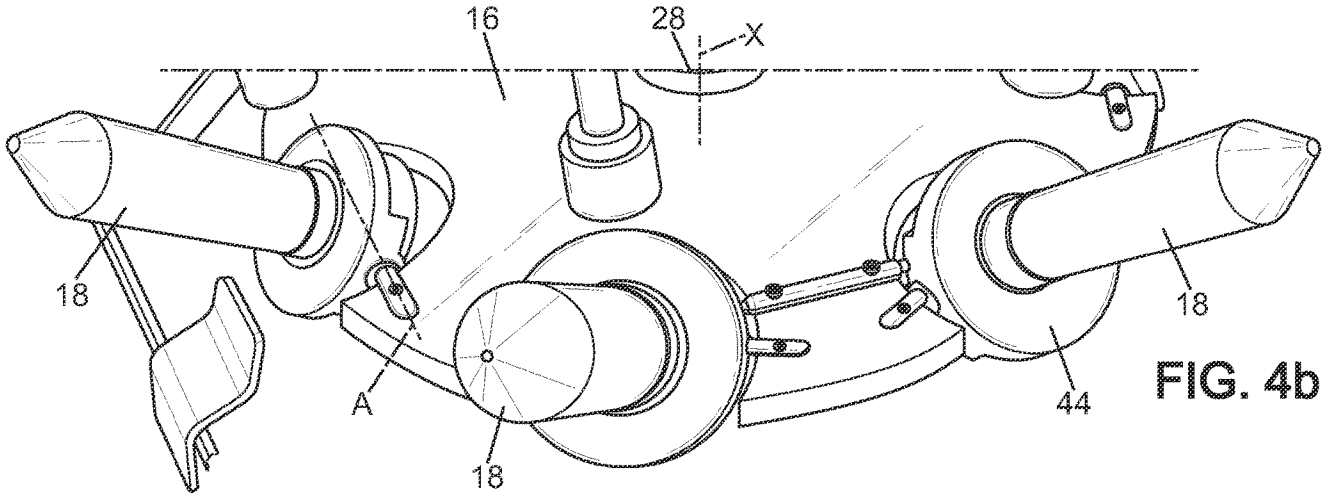
Figure 5A:
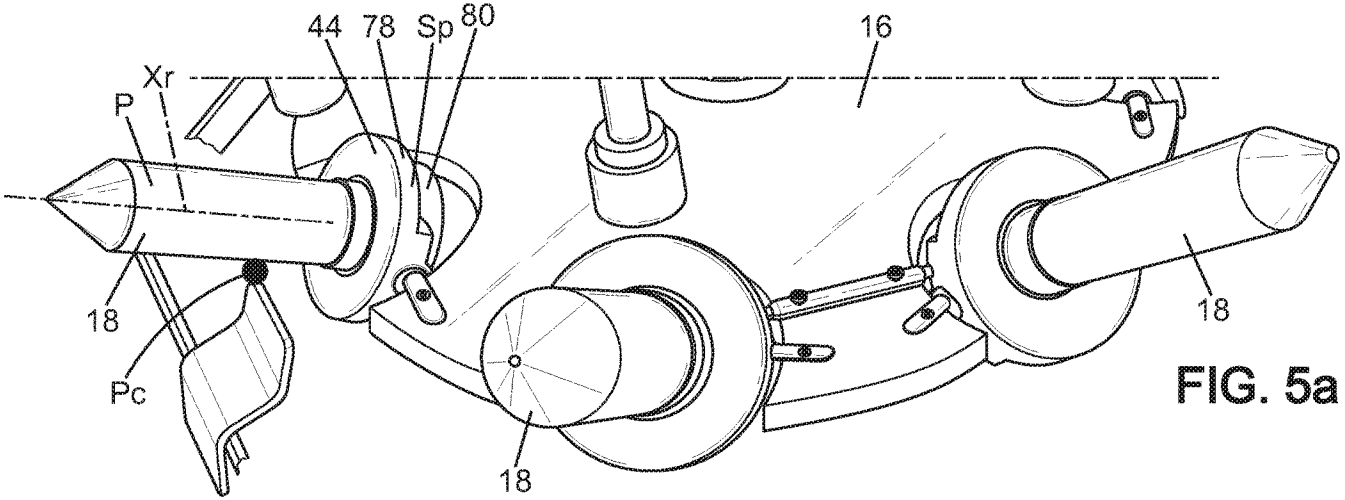
FIGS. 5*a* and 5*b* are enlarged scale views from FIG. 1 showing the containers according to the two different positions.
Figure 5B:
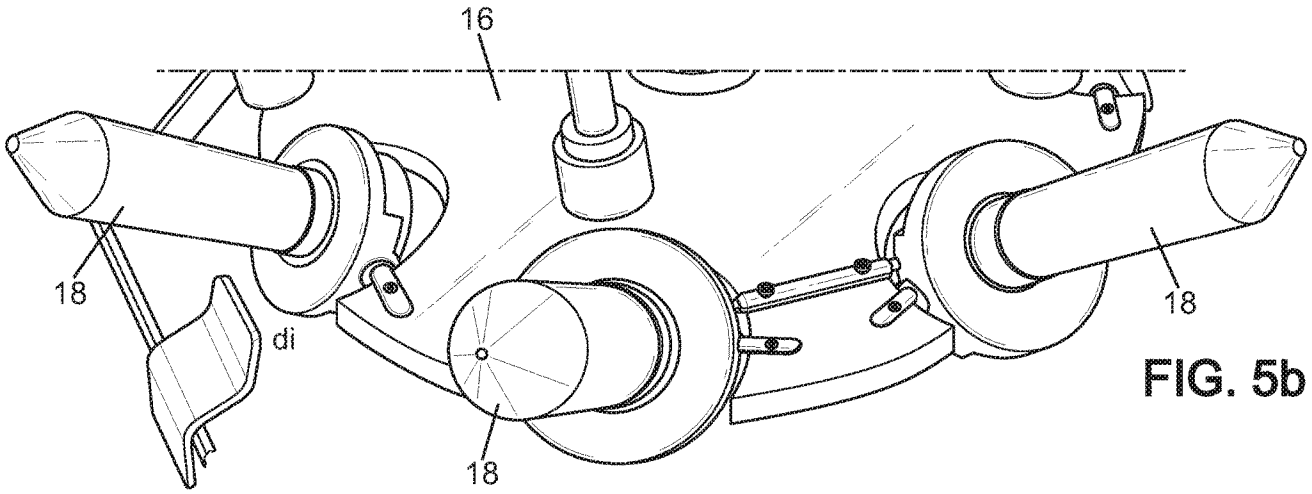

When the movement frequency of the second plate 16 increases and exceeds a value of 3 Hz, in particular during oscillations of the second plate of order 5 Hz, the container body 18 separates from the stop, as shown in FIG. 4*b* or 5*b*.

By comparison with FIGS. 4*a* and 5*a*, a space between the hollow body 37 and the stop 14 can be seen on FIGS. 4*b* and 5*b*. In other words, the hollow body 37 of the container 18 and the stop separate by a distance di (shown on FIG. 5*b*), from rotation around the plate axis A. The container 18 is no longer in contact with the stop 14 during a given moment.

Under the force of gravity combined with the alternating forces created by the alternating movement of the second plate 16, the hollow body 37 of the container 18 comes back into contact with the stop 14. More specifically, an impact or collision takes place between the container 18 and the stop 14. The impact is elastic or else quasi-elastic and consequently the container 18 rebounds after contact with the stop 14. The alternating and repeated movement of the second plate 16 between the distal position thereof and the proximal position thereof and the kinetic energy released during the collision between the container 18 and the stop 14 contribute to leading to a series of collisions between the container 18 and the second plate 16.

The amplitude of the rotation of container 18 is limited both by the stop 14 on the first plate and also at most by the second stop 82 provided on the second plate 16. The amplitude of rotation is for example less than 120°, for example it is of order 60°. For example, the axis of container 18 has a minimum angle of −7° relative to the horizontal direction and a maximum angle of 53° relative to the horizontal direction. The maximum angle is reached when the collar 46 of the connection unit 44 is stopped on the second stop 82.

The second stop 82 could lead to a second series of impacts (also called upper impacts) which contribute to the random and irregular movement of container 18 between the two extreme positions of the container while pivoting around the plate axis A.

An irregular and/or aperiodic shaking of the container 18 is thus achieved from a periodic movement of the second plate 16. The elastic impact on the stop 14 of the first plate 12, the impact on the second stop 82, the offset position of the center of mass of the container 18 relative to the shaking axis X and the position of the plate axis A near the second end 40 of the container 18, and the elongated shape of the container 18 contribute to the irregularity of the shaking which could be described as quasi-chaotic.

In other words, while being slid in the first direction X1, the container 18 is thrown rotationally upward (first direction X1) until coming to stop on the second stop 82. The container 18 is thrown downward (second direction X2) by contact with the second stop 82 and/or by gravity and pivots around the plate axis A downward (direction X2) and the movement of the second plate 16. The container 18 comes to stop against the stop 14, with an impact. The combination of the two movements (translation of the second plate and therefore of the second end (or more precisely of the end part in the area of the second end) of the container 18 and rotation around the plate axis A of the end part in the area of the second and 40) causes the shaking with a collision against the stop 14 at the end of travel.

Thus, the product contained in the container 18 moves inside the container 18 over substantially the entire length of the container 18 and is driven by the irregular movement of the container 18 between the first end 38 and the second end 40. Furthermore, the volume of the product contained and/or the mass density thereof can also participate in the frequency "offset" and the irregularity of the shaking by displacing the center of mass of the container with time.

In an implementation variant, the second plate 16 can be provided rotationally movable around the shaking axis X and be moved by the drive unit around the shaking axis X according to an alternating and periodic movement in a first direction of rotation and then in a second direction of rotation so as to cause a movement to the container relative to the second plate and a series of impacts between the container 18 and the stop 14 of the first plate 12 to produce an aperiodic shaking of the container from the periodic and alternating movement of the second plate 16.

A manual shaking is thus reproduced by a simple to implement automatic shaking device with which to conduct tests in series.

In this case, the shaking by device 10 can easily be interrupted and resumed. Programmable logic controllers programmed and equipped with memory can be provided for remotely controlling one or more shaking devices 10 such as those described according to a given process with for example a precise timer and alternation of rest phases or stirring (or shaking) phases. Additionally, the logic controllers can program mixing cycles with specific frequencies and for specific times.

A step of emptying the contents of the container 18 can be provided by tipping the hollow body 37 of the unplugged (in other words unstoppered) container 18 so as to orient the filling opening 42 towards the support S. In particular, the first plate is displaced upward to force the container 18 into this position. The shaking device 10 can, for example, additionally include a drip pan placed under the container 18 and suited for receiving the liquid which was contained in the container 18.

As previously indicated, the shaking device 10 can comprise several similarly arranged containers 18, with each of the containers 18 associated with a stop 14. As shown in FIG. 1, the containers 18 all have the same shape. In implementation variants, however, the containers 18 can have different shapes. Furthermore, the distance between the stop 14 and the container 18 can vary, for example.

For example, the shaking device 10 can be used for shaking a solvent and a flour sample in order to measure the capacity of the flour to absorb solvent as in the previously mentioned standard "AACC—Method 56-11" and to shake the quantity of 25 g of solvent and 5 g of flour to be tested. The shaking is done in sequences of shaking for five seconds every five minutes for 20 minutes after a first step of shaking for five seconds. These times can of course be modified.

However, the present shaking device 10 is not limited to this application and can be implemented in other shaking processes of the same type.

Additionally, the shaking described above can be combined with a centrifuging device to form a shaking and centrifuging device 10.

The shaking and centrifuging device 10 comprises, as previously indicated, a drive system with a drive unit 30 which is in reality a first drive unit 30; additionally, the drive system comprises a second drive unit 100.

The second drive unit 100 is suited for rotationally driving the second plate 16 relative to the frame 20. The second drive unit 100 comprises, for example, a motor such as a brushless motor. In an implementation variant, an asynchronous motor can be used. By means of the spindle shaft 28, the motor rotationally drives the second plate 16 around a centrifuging axis Y which is coincident with the axis of the shaft 28 and consequently with the shaking axis X. The shaft 28 is then rotationally movable relative to the frame 20 around the shaking axis X. The grooves of the shaft 28 engage with a complementary shape provided on the second plate 16 in order to transmit rotational movement around the shaking axis X from the shaft 28 to the second plate 16. In an implementation variant, the rotational movement could be transmitted by a by a belt-and-pulley system or by gears. Similarly, the grooves could be replaced for example by a smooth shaft with keyway.

The shaking and centrifuging device 10 furthermore comprises a selection system 102 suited for alternatively switching from a shaking mode (already described above) to a centrifuging mode, in which an acceleration is imparted to the content of the container 18 through the rotational movement of the second plate 16 relative to the frame 20.

In the shaking mode, the second plate 16 is associated with the first drive unit 30 and disassociated from the second drive unit 100.

In the centrifuging mode, the second plate 16 is associated with the second drive unit 100 and disassociated from the first drive unit 30.

More particularly, as previously described in the shaking mode, the first drive unit 30 is attached to the plate, for example by means of magnetic strike plates described above which avoids the disconnection of the second plate 16 from the first drive unit 30. Additionally, in the shaking mode, the second drive unit 100 is disassociated from the second plate 16 in that it does not rotationally drive the second plate 16 around the centrifuging axis Y. In contrast, the shaft 28 is made rigidly connected with the frame 20. In the example presented above, it is sufficient to not electrically power the motor of the second drive unit 100.

In the centrifuging mode, the second plate 16 is disassembled from the fork 34. There is no longer contact between the branches of the fork and the lower surface 22 of the second plate 16. Additionally, the spindled shaft 28 is released from the frame and attached to the second plate 16. The second plate 16 is rotationally driven around the centrifuging axis Y by the spindled shaft 28.

The selection system 102 includes a processor comprising circuits suited for controlling together the various units in the centrifuging mode, for controlling together the various units in the shaking mode and an actuatable switch for moving from one mode to the other. The switch is either actuatable by a user or automatically according to preprogrammed sequence stored in memory.

The shaking and centrifuging device furthermore includes a fourth plate 104. The contour of the fourth plate 104 is substantially circular. However, in implementation variants, the fourth plate 104 can have other shapes.

The first, third and fourth plate are borne by the frame 20 without engaging with the spindled shaft 28. Thus, the rotation of the spindled shaft 28 does not rotationally drive the other plates.

The fourth plate 104 is substantially horizontal. The fourth plate 104 is for example centered around the shaking axis X. The fourth plate 104 has a lower surface 106 directed towards the support S and the second plate 16. The fourth plate 104 has an upper surface 108, opposite said lower surface 106. The fourth plate 104 is assembled directly onto the frame 20. The fourth plate 104 and the second plate 16 are rotationally movable relative to each other.

The fourth plate is assembled to the frame 20 in particular by means of a wheel and endless-screw type system where the axis of the screw substantially defines the main axis of the fourth plate and is substantially coaxial with the shaking axis X. The fourth plate 104 is subsequently translationally movable relative to the frame 20.

The fourth plate 104 comprises an orifice 110. As shown on FIG. 1, the fourth plate 104 comprises a plurality of through orifices 110 that could be provided with elements 112 blocking the orifices 110. More precisely, the fourth plate 104 comprises the same number of orifices 110 as the number of recesses 36 provided in the second plate. Each orifice 110 can be moved facing the filling opening 42 in container 18 when said container 18 is in mounted position on the second plate 16.

Figure 6B:
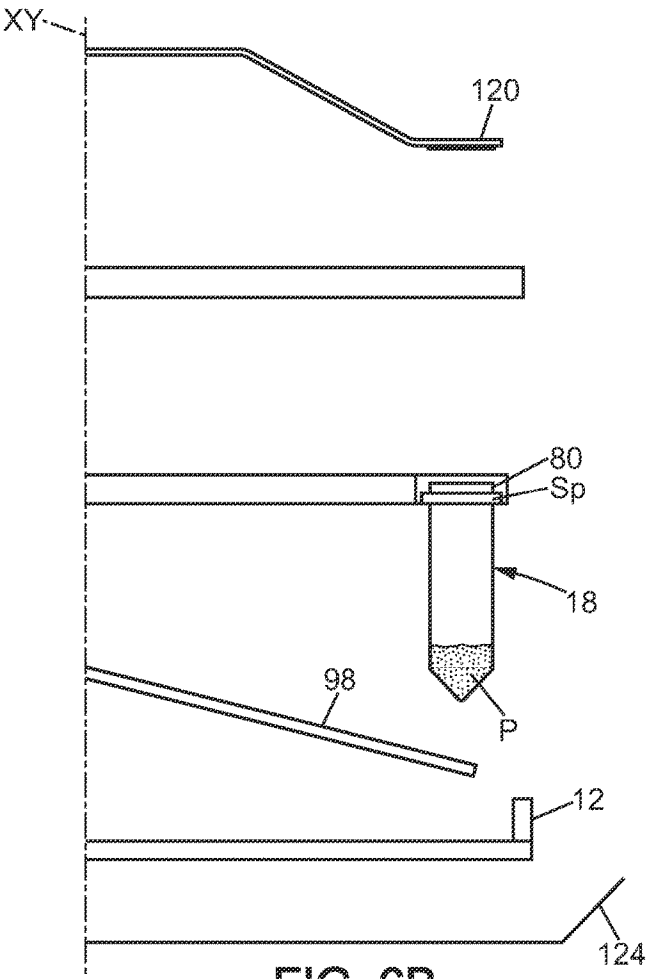
FIG. 6A to 6P are schematic section views of the shaking and centrifuging device from FIG. 1 showing various steps of the process of shaking and centrifuging a container.
Figure 6A:
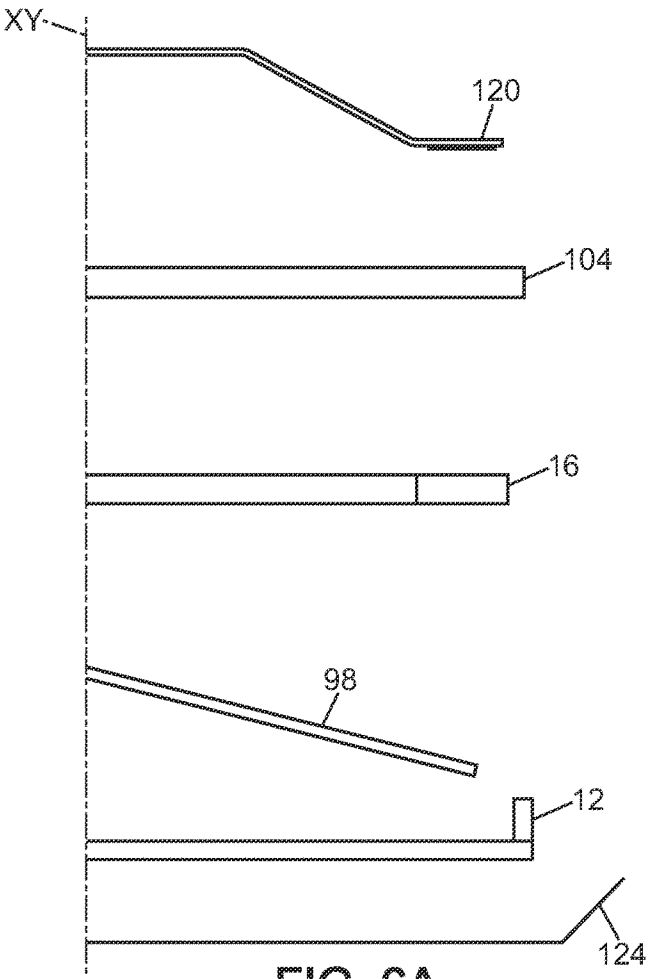
Figure 6D:
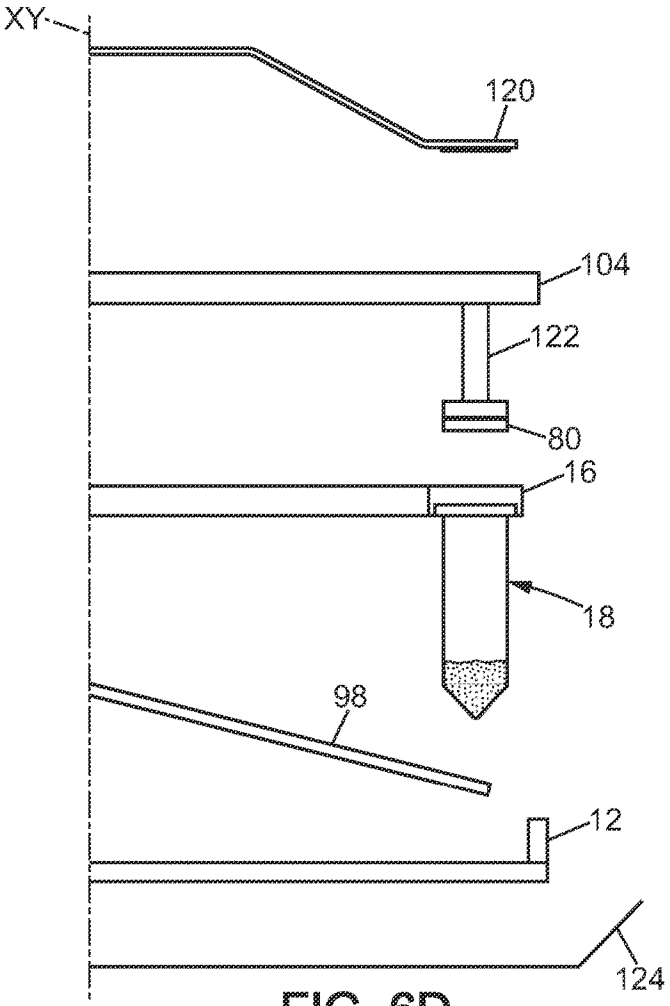
Figure 6C:
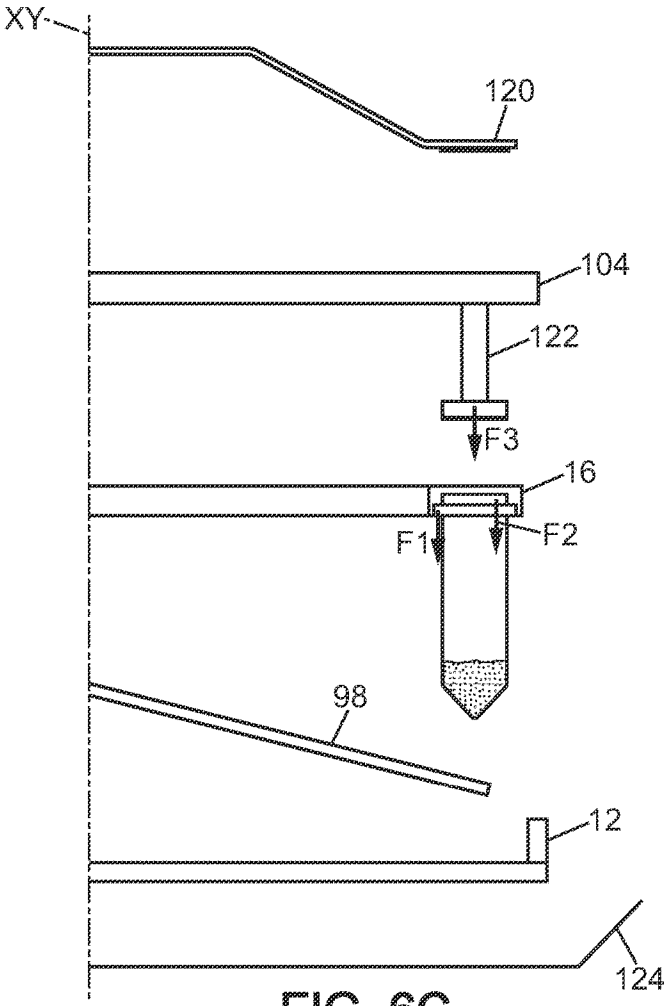
Figure 6F:
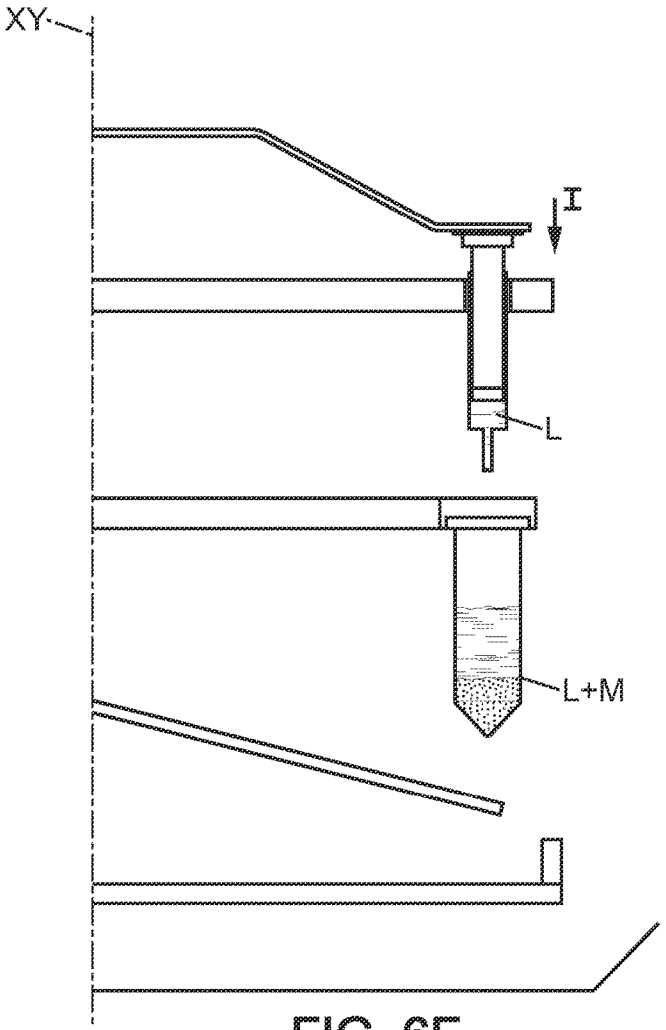
Figure 6E:
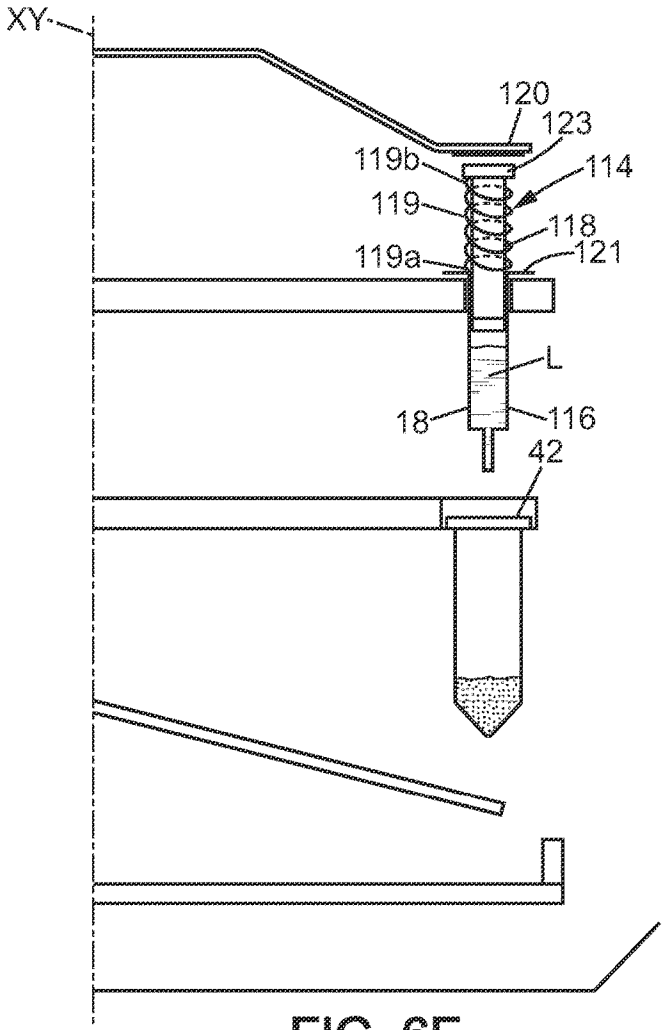

Each orifice 110 is suited and intended to receive and hold an injection unit 114 (see FIG. 6E). The injection unit 114 is received in the orifice 110 and is born by the rim of the orifice.

The injection unit 114 is intended to contain a liquid product L, for example a solvent, suited for being injected into the container 18.

The injection unit 114 is, for example, syringe type comprising a substantially cylindrical reservoir 116 suited for receiving the liquid product L to be injected, a piston 118 translationally movable between an upper position and a lower end of travel position, for example inside the reservoir 116, in order to empty said reservoir of the content thereof.

The reservoir 116 has a content of order 30 mL, for example.

The piston 118 is suited for being actuated by a control arm 120, especially for injecting the liquid product L contained in the reservoir 116. The control arm 120 is translationally displaced relative to the fourth plate 115 between an upper position, in which it is away from the piston 118, and a low position wherein it forces the piston 118 into the low position thereof. For example, the control arm 120 is moved translationally relative to the fourth plate 104 along an axis parallel to the shaking axis X via a motor system, for example of the type comprising a motor and a wheel and endless-screw system.

The injection unit 114 can comprise an "anti-drip" device 119 as visible on FIG. 6E. For example, the anti-drip device 119 comprises a restoring element, such as a restoring spring, for the piston 118. The restoring spring, as shown in FIG. 6E is wound around the piston 118 The restoring spring is arranged on the outside of the reservoir 116. Thus, the restoring spring is not in direct contact with the liquid product L present in the reservoir 116. In this case, the restoring spring is arranged between an external collar 128 of the reservoir 116 and an actuation portion 123 of the piston 118. More precisely, the restoring spring comprises a first end 119*a* and a second end 119*b*, where the first end 119*a* of the restoring spring presses against the outer collar 121 and the second end 119*b* of the restoring spring presses against the actuating portion 123.

In this case, the restoring spring returns the piston 118 from the lower end-of-travel position thereof to an intermediate position thereof, the intermediate position being oriented toward the upper position. Thus, once the control arm 120 stops exerting a force on the piston 118, the restoring spring exerts a force on the piston so as to return the piston to the intermediate position thereof. In other words, only the upper position of the piston 118 is stable. Specifically, the restoring spring is sized such that the force applied by the actuating arm 120 on the piston 118 (and more specifically on the actuating part 123 of the piston 118) is greater than the force applied on the piston by the restoring spring. Thus the actuating arm 120 moves the piston 118 without stress from an upper or intermediate position thereof to the lower position thereof.

Specifically, there are as many control arms 120 as injection units 114 to be controlled and as containers 18 to be filled.

The control arm 120 is in this case assembled to the frame 20, and could be rotationally movable relative to the frame 20 on an axis coaxial to the shaking axis X and in the extension (upward) of the spindled shaft 28.

When the control arm 120 stops exerting a force on the piston 118, after the liquid L has been injected into the reservoir 116, the restoring spring 119 directly returns the piston 118 to the intermediate position thereof. With this arrangement, the possible traces of liquid, which had not fallen in the container 18 and had been retained, in particular by capillary force, outside of the reservoir 116 of the injection unit 114, can be re-aspirated into the reservoir 116.

The anti-drip device of the injection unit is particularly important for avoiding residues falling randomly on components of the shaking and centrifuging device 10 and managing to pollute or damage the device.

A prehension unit 122 for the stoppers is also provided on the shaking and centrifuging device 10. The prehension unit 122 of the stoppers 80 is, for example, an electromagnetic strike plate suited for creating a magnetic field and producing an attractive force on the stoppers 80 whose magnitude is a less than the magnitude of the retention force F1 (see FIG. 6C) of the container 18 on the collar 46 and greater than the magnitude of the retention force F2 (see FIG. 6C) of the stopper 80 on the container 18 so as to be able to pull the stopper 80 away from the container without displacing the body of the container 18 from the collar 46.

The shaking and centrifuging device 10 can also comprise a drip pan 124 (shown in dashes in FIG. 1) positioned, for example, below the container 18 and suited for receiving a liquid content from container 18 when it is in inclined position relative to the shaking axis X, with the filling opening 42 directed towards the support S.

The drip pan 124 has, for example, a substantially circular contour, centered on the shaking axis X and substantially horizontal. However, in implementation variants, the drip pan 124 can have other shapes. In this case, the drip pan is attached relative to the frame 20; it is directly assembled on the frame 20, but could be rotationally movable.

The dimensions of the drip pan 124 are calculated based on the dimensions of the container 18 and the second plate 16 such that the drip pan can receive all of the liquid content emptied from the container.

Figure 6H:
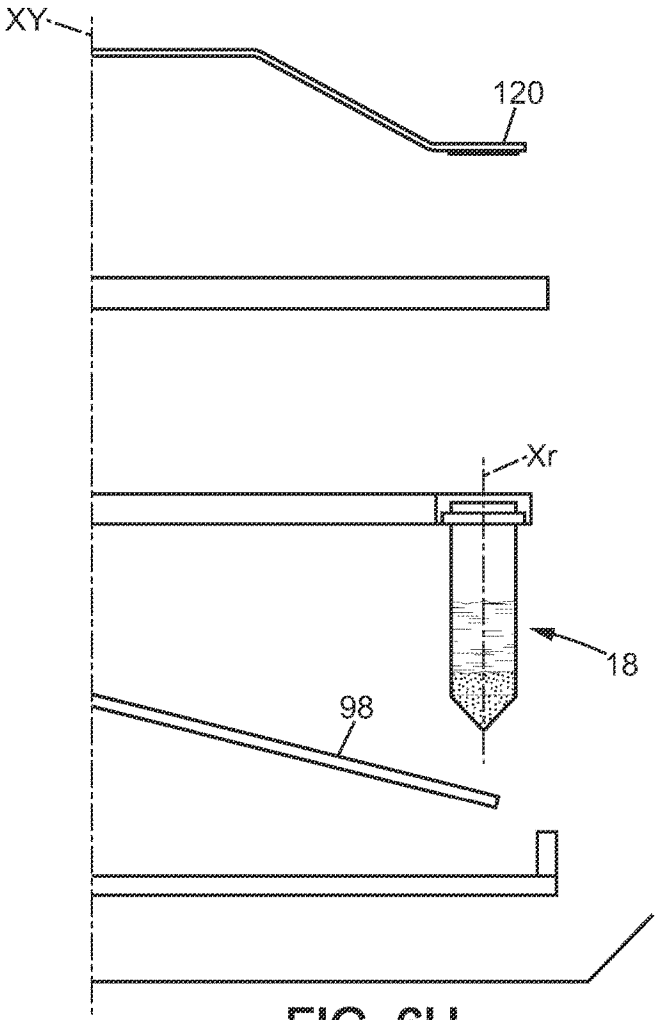
Figure 6G:
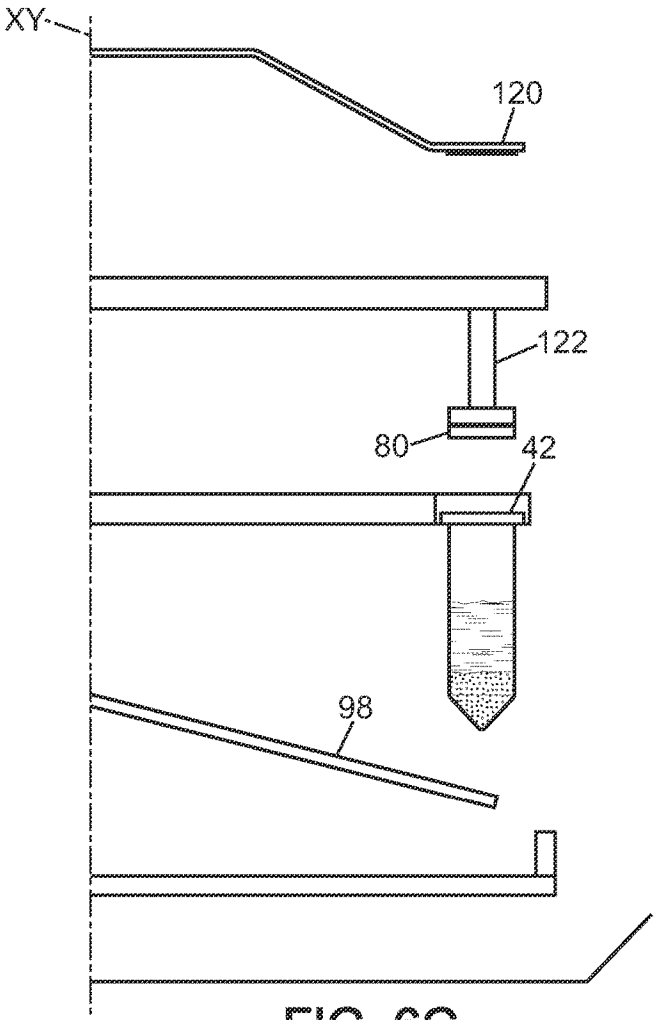
Figure 6J:
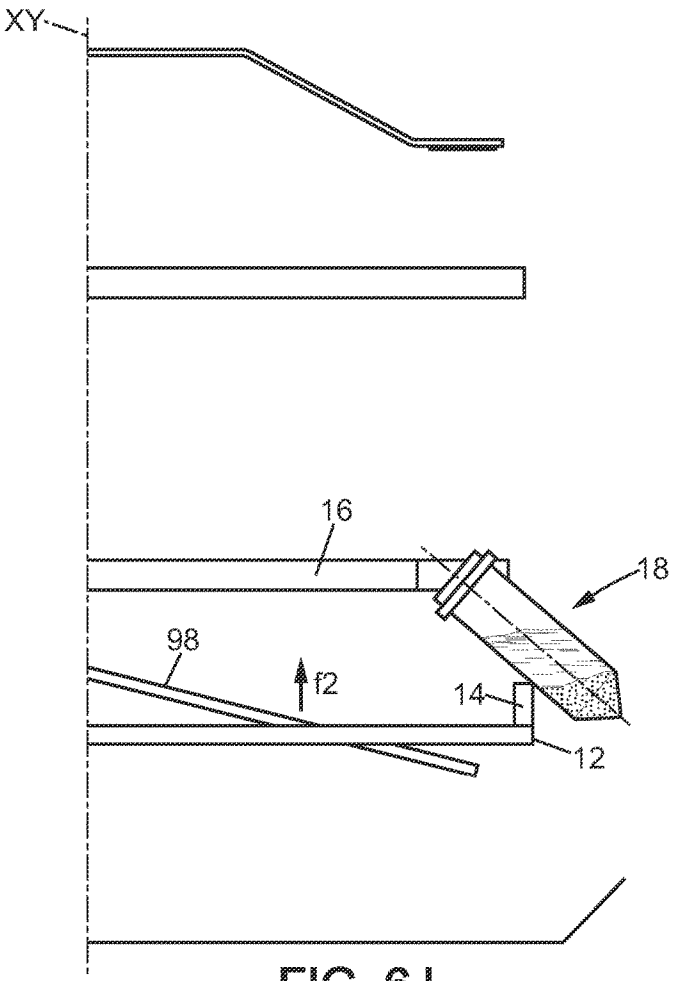
Figure 6I:
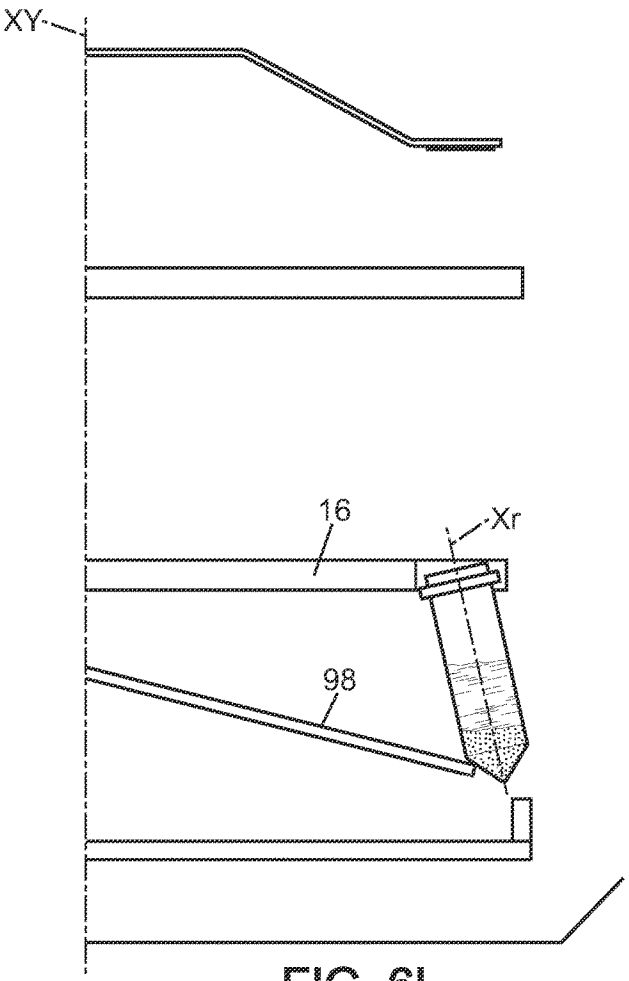
Figure 6L:
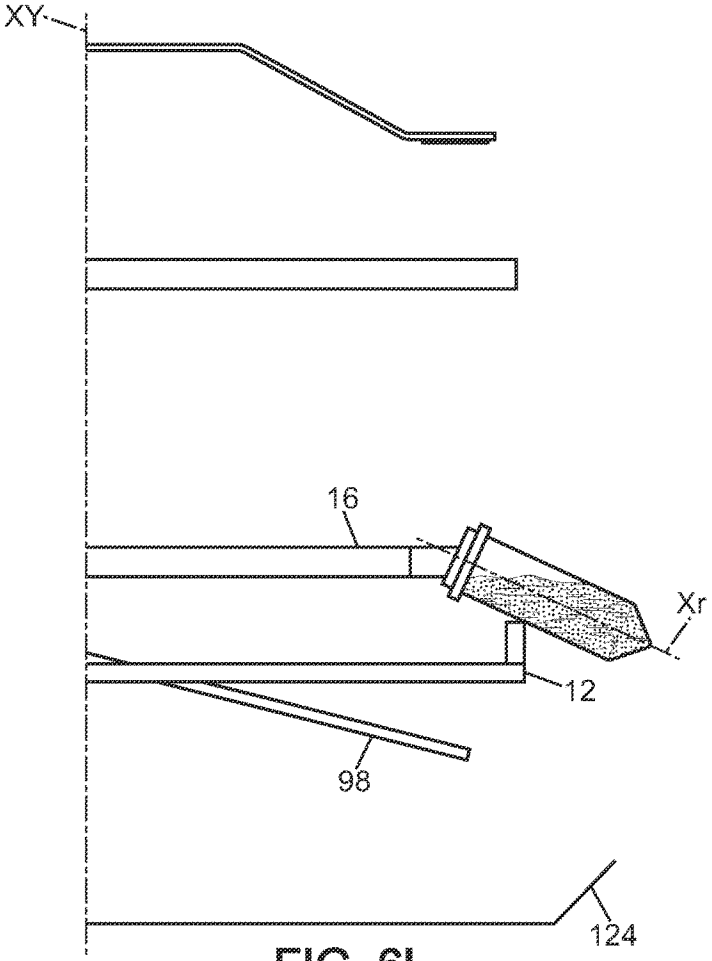
Figure 6K:
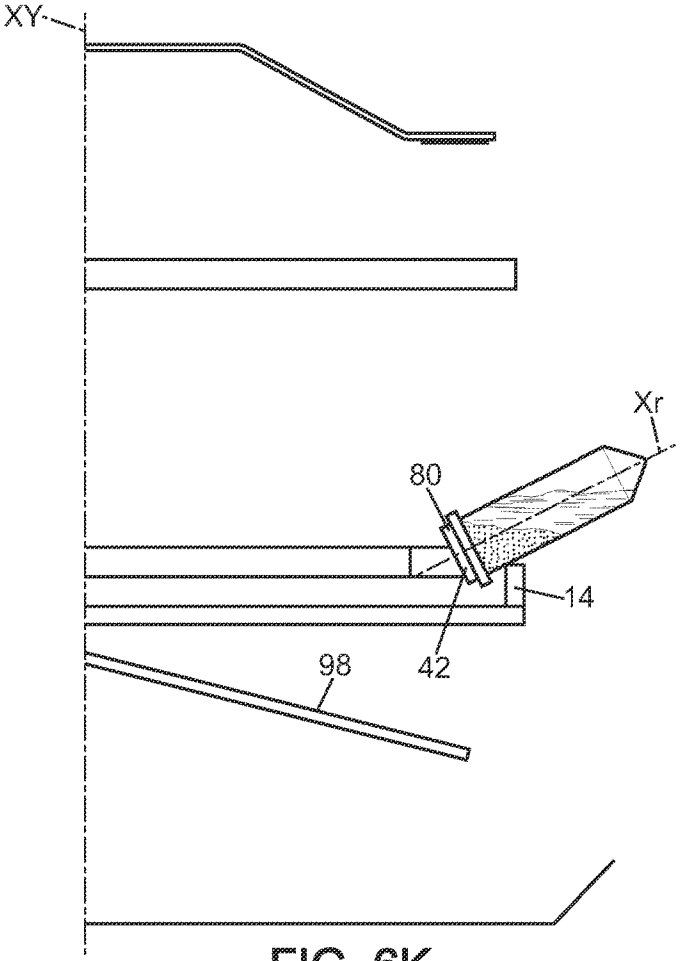
Figure 6N:
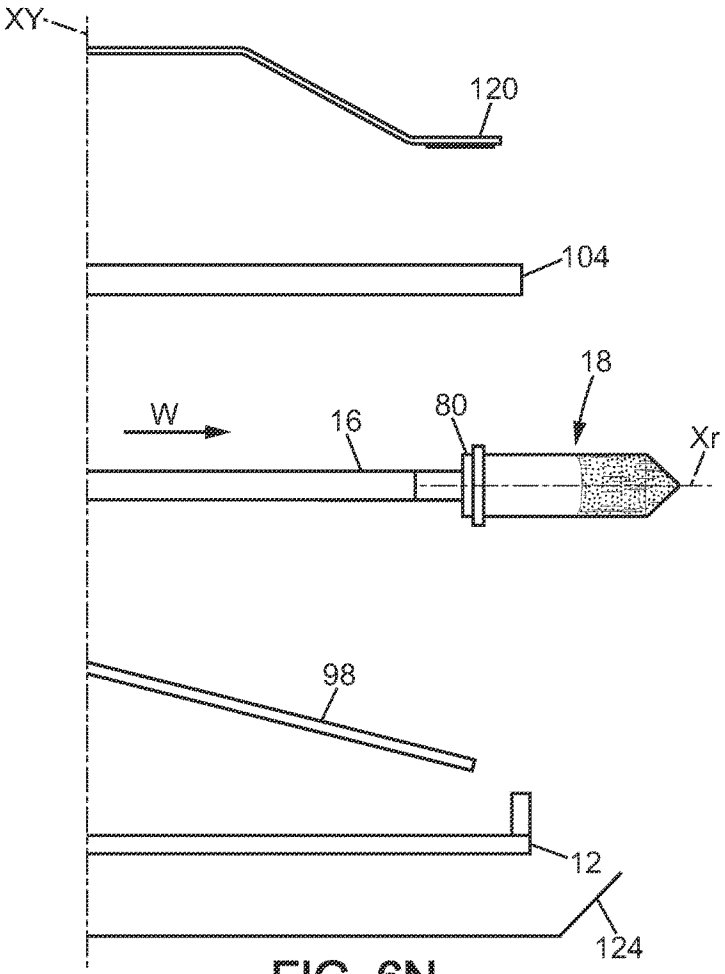
Figure 6M:
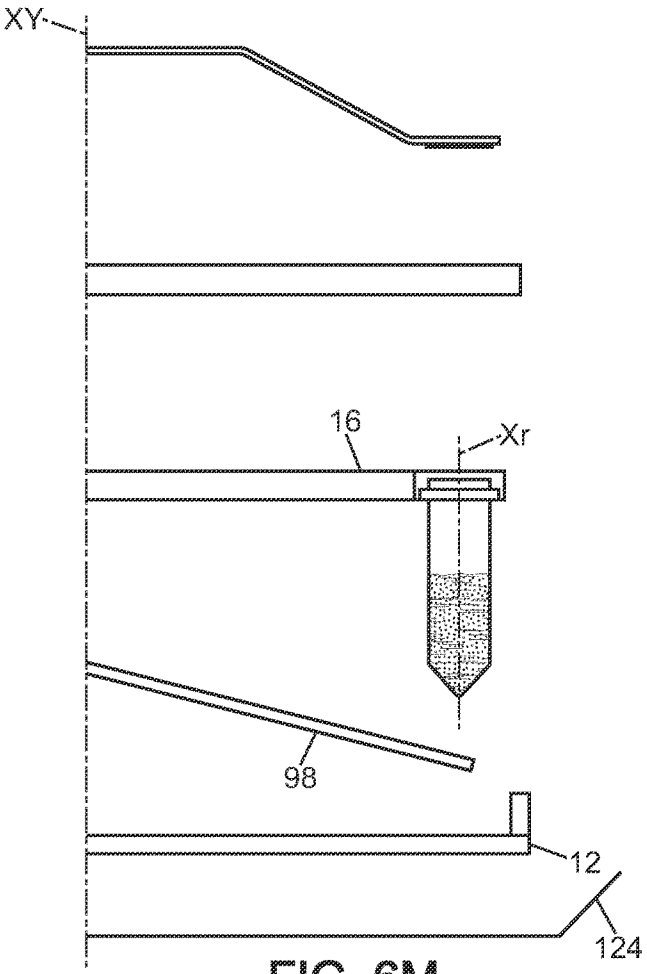
Figure 6P:
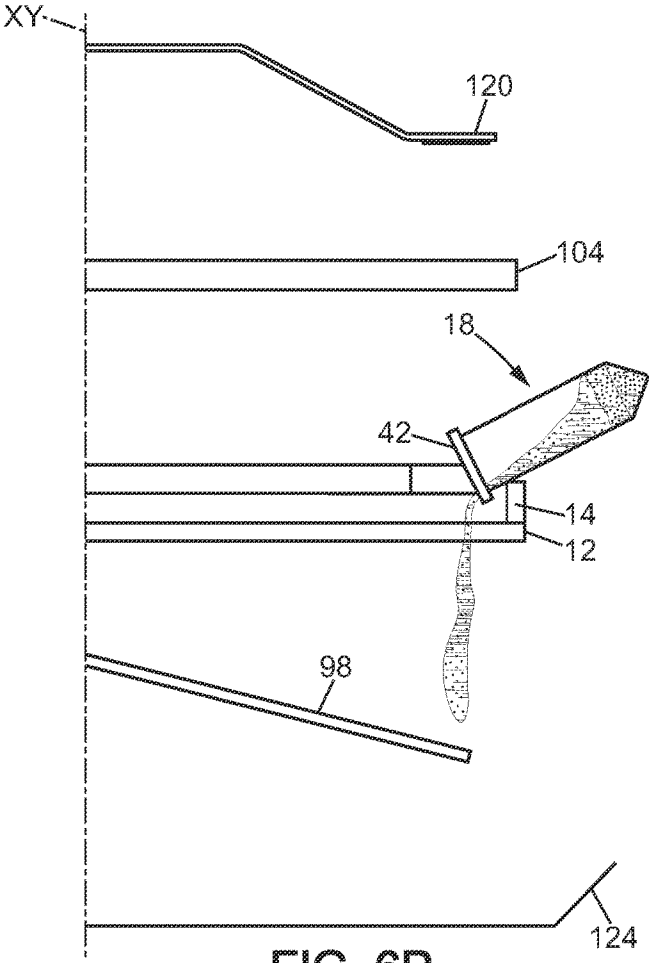
Figure 6O:
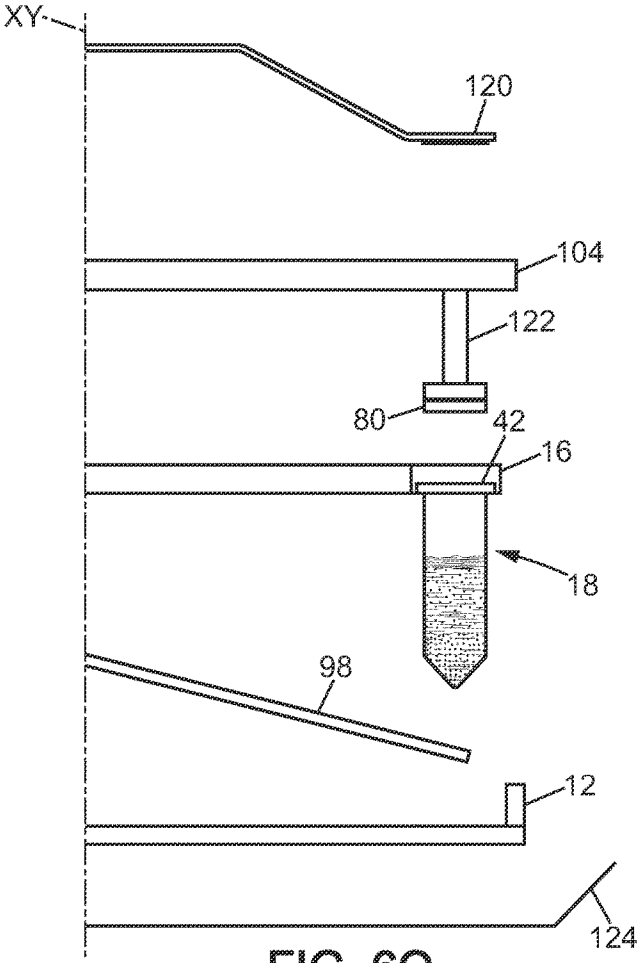

FIGS. 6A to 6O show schematically the possible steps of shaking and centrifuging a content of container 18 for conducting a test.

As shown in FIG. 6A, we first have a shaking and centrifuging device 10, as previously described, comprising, from bottom to top, the drip pan 124, the first plate 12, the third plate 98, the second plate 16, the fourth plate 104 and the control arm 120. As shown in FIG. 6A, the first plate 12, the third plate 98, the second plate 16, the fourth plate 104 and the control arm 120 are in a position referred to as resting or initial.

In a first step, shown in FIG. 6B, the container 18 was just put in position, for example already prefilled with the material in the pulverulent state and plugged (the stopper 80 for the container 18 is retained by a retention force F2 created by magnetic elements located in the stopper 80 and in the support portion for container 18).

Figure 7:
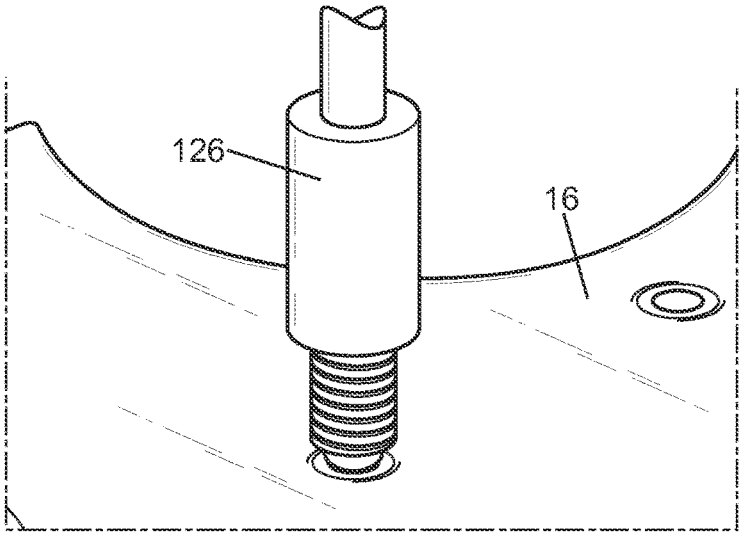
FIG. 7 is a perspective view of an angular position indexer for the second plate of the shaking and centrifuging device from FIG. 1.

In a second step, the second plate 16 has just, for example, been rotationally moved relative to the fourth plate 104 so as to position the prehension unit 122 (carried by the fourth plate 104) and the container 18 facing each other, as shown in FIG. 6C. An angular position indexer 126 (shown in FIG. 7) could be provided on the shaking and centrifuging device 10 for indexing the angular position of the second plate 12, for example. Furthermore, in an implementation variant, the fourth plate 104 can be rotationally displaced relative to the second plate 12 so as to bring the prehension unit 122 and the container 18 opposite each other.

In the third step, the fourth plate 104 is displaced translationally relative to the frame 20 and relative to the second plate 16 along the shaking axis X so as to bring the prehension unit 122 (comprising magnetic elements) into contact with the stopper 80. An attractive force F3 on the collar 46 is created whose magnitude is greater than the retention force F2 of the stopper on the container but less than the retention force F1 of the container 18. The prehension unit 122 "unstoppers" the container 18 by attraction for the stopper 80 at a remove from the support portion of the container 18, as shown in FIG. 6D, by moving the fourth plate 104 carrying the stoppers 80 in the opposite direction (here upwards).

In a fourth step, the second plate 16 is again rotationally displaced relative to the fourth plate 104 so as to bring the orifice 110—wherein the injection unit 114 with the piston 118 an upper position was previously placed—and the filling orifice 42 of the container 18 opposite each other, as shown in FIG. 6E.

In a fifth step, illustrated in FIG. 6F, the control arm 120 is displaced translationally along the shaking axis from its upper position, in which it is away from the piston 118, to its lower position according to arrow I. As necessary, the fourth plate 104 is also displaced downward to bring the reservoir 116 closer to the container 18 for the injection.

After injection of the liquid L contained in the reservoir 116 of the injection unit 114 into the container 18, in a sixth step the control arm 120 and the fourth plate 104 are again moved translationally toward their upper positions. The anti-drip device 119 could then aspirate possible residual traces of liquid, in particular by returning the position 118 of the injection unit 114 into intermediate position. The second plate 16 is then displaced rotationally relative to the fourth plate 104 to again bring the prehension unit 122 for the stopper 80, together with the stopper 80, opposite the filling opening 42 of the container 18 as shown in FIG. 6G. The prehension unit 122 is moved translationally so as to bring the stopper 80 and the support part Sp of the container 18 in contact and then the magnetic field exerted by the prehension unit 122 is reduced such that the magnitude of the attractive force between the prehension unit 122 in the stopper 80 is less than the magnitude of the retention force F2 between the stopper and the container. The stopper 80 then closes the container 18 and the prehension unit 122 of the stopper 80 is next moved away from the container 18.

In a seventh step, shown in FIG. 6H, a shaking step is implemented. The second plate is displaced in proximal position until making the body of the container 18 come in contact with the third plate 98 and inclining the axis Xr of the container 18 relative to the vertical direction as shown in FIG. 6I.

In an eighth step, the first plate 12 is displaced translationally until coming into contact with the body of the container 18, as shown in FIG. 6J. More specifically, the stop 14 of the first plate 12 comes in contact with the body of the container 18. As shown in FIG. 6J, the first plate 12 continues the translational movement thereof along the arrow F2 until the container 18 is inclined such that the end thereof comprising the filling opening 42 is oriented towards the support S, as shown in FIG. 6K. During this movement, the first plate 12 passes by the third plate 98.

In the ninth step, shown in FIG. 6L, the second plate 16 is displaced according to a translationally alternated movement so as to perform the shaking, in particular the aperiodic shaking described above, of the content of container 18.

In a tenth step, once the shaking of the container 18 has finished, the first plate 12 is displaced translationally towards the support S. The angle of inclination of the axis Xr of the container relative to the shaking axis X decreases with translation of the first plate 12 towards the support S until the body of the container 18 comes into contact with the third plate 98.

The first plate 12 is displaced translationally until in a position where it is no longer in contact with the container 18, for example until in the resting position thereof, as shown in FIG. 6M.

In an eleventh step, shown in FIG. 6N, a step of centrifuging is implemented. The second drive unit 100 is actuated so as to rotationally displace the second plate 16 around the shaking axis (coincident with the centrifuging axis Y) and to centrifuge the shaking content of container 18. The second plate 16 spins at an angular speed which can reach 2000 RPM, which leads to the inclination of the axis Xr of the container 18. The axis Xr of the container is substantially horizontal. During centrifuging, the container 18 and the content thereof are subject to an acceleration due to the combination of centripetal force and inertia. The portions of the content with a different density are separated.

At the end of the centrifuging step, the rotational movement of the second plate 16 is progressively reduced until completely stopped.

The shaking and centrifuging steps can, if called for, be repeated alternately, for variable times and with variable time intervals.

Container 18 (and more specifically axis Xr thereof) is again vertically oriented, so as to be able to withdraw the stopper ET according to a procedure similar to that of the second and third steps (with the prehension unit 22 coming to exert an attractive force for managing to unstop the container 18).

The axis X of container 18 is subsequently again inclined by translation of the second plate and by contact with the third plate 98 and then by the first plate 12 so as to empty (see FIG. 6P) the liquid content of the container into the drip pan 124 after centrifuging and shaking by orienting the filling opening 42 toward said drip pan 124.

Then, in the last step, the first plate 12 and the second plate 16, successively or simultaneously, are displaced translationally towards the support as for the first plate 12 and in distal position for the second plate 16 so as to drive the container 18 to a position, referred to as origin, wherein the axis Xr of the container is substantially vertical.

A programmable logic controller could optionally be provided for placement and withdrawal of the containers 18 on the collars 46 of the second plate 16 and/or injection unit 114. The content remaining in the container 18 can be analyzed and weighed for estimating properties of the pulverulent product.

Additionally, a system for measuring the weight of the content of the drip pan 124, after the shaken liquid content of the container 18 has been emptied there into, can be provided.

This shaking and centrifuging device 10 can in particular be used for measuring the capacity of flour for absorbing solvents as in the aforementioned standard "AACC—Method 56-11". Just the same, the present shaking and centrifuging device is not limited to this application and can be used in other shaking and centrifuging processes of the same type, in particular for contents including multiple components comprising a dissociable element.

The invention claimed is:

1. A device for shaking, within a rigid container, content comprising a material in powder form and a liquid product, for the purpose of conducting a test on the shaken content, said container having a capacity of less than one liter and able to hold an amount of content suitable for conducting the test, comprising:

a frame, a first plate assembled directly or indirectly to the frame, a second plate assembled indirectly to the frame, arranged close to the first plate and movable relative to the frame and to the first plate, and a drive unit suitable for moving the second plate relative to the frame and to the first plate, wherein,—the container is carried by the second plate and is movably mounted relative to the second plate, the first plate comprises a stop, said stop being arranged near to and facing the container, the stop being fixedly mounted on the first plate, and the second plate is moved relative to the first plate by the drive unit, in an alternating and repeating translational and/or rotational motion between a proximal position and a distal position, so as to move the container relative to the second plate and cause a series of impacts between the container and the stop in order to achieve a non-periodic shaking of the container by the alternating and repeating motion of the second plate.

2. The shaking device according to claim 1, wherein the second plate has a plate axis, and the container is assembled to the second plate and is rotatable about the plate axis.

3. The shaking device according to claim 2, wherein the container is a test tube and comprises a rigid hollow body extending longitudinally along a container axis between a first end and a second end, the second end defining an opening for the filling thereof, and wherein the plate axis is located substantially nearer to the first end or to the second end.

4. The shaking device according to claim 3, wherein the container is detachably associated with the second plate, wherein the second plate comprises a recess, and the shaking device further comprises a connecting member which connects the container to the second plate, said connecting member cooperating with the recess and being secured to the second plate and rotatable relative to the second plate about the plate axis, said connecting member comprising:

a first portion for detachably receiving the container, and a second portion extending along the plate axis, allowing rotation of the container about the plate axis relative to the second plate.

5. The shaking device according to claim 3, wherein the second plate has a second stop limiting the angular travel of the container about the plate axis.

6. The shaking device according to claim 3, wherein pivoting of the container about the plate axis has an angular travel of less than 120°.

7. The shaking device according to claim 3, wherein pivoting of the container about the plate axis has an angular travel of 60°.

8. The shaking device according to claim 1, wherein the stop is a rigid stop and the impact between the container and the stop is an elastic or quasi-elastic collision.

9. The shaking device according to claim 1, wherein the drive unit moves the second plate in translation with respect to the first plate, between the proximal position and the distal position, along a shaking axis in a first direction and in a second direction that is opposite the first direction.

10. The shaking device according to claim 9, wherein the second plate has a plate axis, the container is assembled to the second plate and is rotatable about the plate axis, and the shaking axis is orthogonal to the plate axis.

11. The shaking device according to claim 1, wherein the course of the second plate between the proximal position and the distal position is between 10 millimeters and 50 millimeters in length.

12. The shaking device according to claim 1, wherein the drive unit moves the second plate in a periodic motion at a frequency of between 1 and 10 Hertz.

13. The shaking device according to claim 1, comprising a plurality of containers, wherein the first plate defines a central axis and the second plate defines a second central axis with the first and second axes being coaxial, the first plate comprises the same number of stops as the number of containers, and each container is associated with a stop.

14. A use of the shaking device according to claim 1, for the purpose of measuring the absorption capacity of a flour sample for a solvent.

15. A method for shaking a container, comprising the steps of:

having a shaking device according to claim 1, partially filling the container with a material in powder form and with a liquid product, setting the second plate in motion by the drive unit in an alternating and repeating translational and/or rotational motion so as to move the container relative to the second plate and cause a series of impacts between the container and the stop in order to achieve a non-periodic shaking of the container by the alternating motion of the second plate, stopping the movement of the second plate.

16. The method for shaking a container according to claim 15, wherein the steps of setting the second plate in motion and stopping the motion of the second plate are repeated.

17. The method for shaking a container according to claim 15, further comprising a step of placing the container on the second plate and a step of removing the container from the second plate.

18. The shaking device according to claim 1, wherein the course of the second plate between the proximal position and the distal position is 35 millimeters.

19. The shaking device according to claim 1, wherein the second plate is moved relative to the first plate by the drive unit, in the alternating and repeating translational or rotational motion between the proximal position and the distal position, so as to move the container relative to the second plate and cause the series of impacts between the container and the stop in order to achieve the non-periodic shaking of the container by the alternating and repeating motion of the second plate.

20. The shaking device according to claim 1, wherein the second plate is moved relative to the first plate by the drive unit, in the alternating and repeating translational and rotational motion between the proximal position and the distal position, so as to move the container relative to the second plate and cause the series of impacts between the container and the stop in order to achieve the non-periodic shaking of the container by the alternating and repeating motion of the second plate.

* * * * *